United States Patent [19]

Chen et al.

[11] Patent Number: 4,919,788

[45] Date of Patent: Apr. 24, 1990

[54] LUBRICANT PRODUCTION PROCESS

[75] Inventors: Nai Y. Chen, Titusville; William E. Garwood, Haddonfield; Tracy J. Huang, Lawrenceville; Quang N. Le, Cherry Hill; Stephen S. Wong, Medford, all of N.J.

[73] Assignee: Mobil Oil Corporation, New York, N.Y.

[21] Appl. No.: 260,857

[22] Filed: Oct. 21, 1988

Related U.S. Application Data

[63] Continuation-in-part of Ser. No. 793,937, Nov. 1, 1985, abandoned, and a continuation-in-part of Ser. No. 821,125, Jan. 22, 1986, abandoned, which is a continuation-in-part of Ser. No. 685,089, Dec. 21, 1984, abandoned.

[51] Int. Cl.[5] ..... C10G 67/02; C10G 69/02

[52] U.S. Cl. ..... 208/59; 208/18; 208/49; 208/111; 585/739

[58] Field of Search ..... 208/59, 18, 49, 58, 208/111; 585/739

[56] References Cited

U.S. PATENT DOCUMENTS

| | | | |
|---|---|---|---|
| 3,308,052 | 3/1967 | Ireland et al. | 208/18 |
| 3,385,781 | 5/1968 | Hamner et al. | 208/111 |
| 3,630,885 | 12/1971 | Egan | 208/59 |
| 3,647,678 | 3/1972 | Egan | 208/59 |
| 3,654,128 | 4/1972 | Woodle . | |
| 3,684,691 | 8/1972 | Arey et al. | 208/102 |
| 3,755,138 | 8/1973 | Chen et al. | 208/33 |
| 3,755,145 | 8/1973 | Orkin | 208/18 |
| 3,758,402 | 9/1973 | Oleck et al. | 208/111 |
| 3,894,938 | 7/1975 | Gorring et al. | 208/97 |
| 4,001,106 | 1/1977 | Plank et al. | 208/59 |
| 4,137,148 | 1/1979 | Gillespie et al. | 208/87 |
| 4,176,050 | 11/1979 | Chen et al. | 208/111 |

(List continued on next page.)

FOREIGN PATENT DOCUMENTS

| | | | |
|---|---|---|---|
| 0188898 | 7/1986 | European Pat. Off. | 208/59 |
| 1390359 | 4/1975 | United Kingdom | 208/18 |
| 1429494 | 3/1976 | United Kingdom | 208/18 |

OTHER PUBLICATIONS

*Developments in Lubrication,* PD 19(2), 221–228, Bull et al.

"Characterization of the Acidity of Zeolite Beta by FTi.r. Spectroscopy and t.p.d. of $NH_3$", ZEOLITES, 1989, vol. 9, May, Hegde et al., p. 231.

*Primary Examiner*—Anthony McFarlane

*Attorney, Agent, or Firm*—Alexander J. McKillop; Charles J. Speciale; Malcolm D. Keen

[57] ABSTRACT

A process for producing lubricant oils of low pour point and high viscosity index by first carrying out a partial dewaxing of a lubricant base stock in an initial catalytic dewaxing operation, followed by a selective dewaxing step. The initial catalytic dewaxing step is carried out using a large pore, high silica zeolite dewaxing catalyst such as high silica Y or zeolite beta which dewaxes by isomerizing the waxy components of the base stock to less waxy brance chain isoparaffins but the severity of the operation is controlled so as to effect only a partial removal of the waxy components. Further removal of the waxy components is effected during the subsequent dewaxing step which is selective for the removal of the more waxy n-paraffin components, leaving the branched chain isoparaffins which contribute to a high VI in the product. The selective dewaxing step may be either a solvent, e.g. MEK dewaxing operation or a catalytic dewaxing using a highly shape selective zeolite such as ZSM-22 or ZSM-23. The severity of the initial catalytic dewaxing operation may be controlled so as to effect a net increase in the content of isoparaffins and because of the selective nature of the solvent dewaxing step, this increased isoparaffins concentration may be retained, producing a product of high VI. The pour point of the feedstock is preferably reduced during the initial catalytic dewaxing step to a value which is no lower than 10° F. and preferably no lower than 20° F., above the target pour point for the products. Generally, this will entail a reduction of at least 10° F. and preferably at least 20° F. in the pour point of the feed.

30 Claims, 4 Drawing Sheets

U.S. PATENT DOCUMENTS

| | | | |
|---|---|---|---|
| 4,229,282 | 10/1980 | Peters et al. | 208/111 |
| 4,283,271 | 8/1981 | Garwood et al. | 208/95 |
| 4,292,166 | 9/1981 | Gorring et al. | 208/97 |
| 4,347,121 | 8/1982 | Mayer et al. | 208/18 |
| 4,372,839 | 2/1983 | Oleck et al. | 208/111 |
| 4,394,249 | 7/1983 | Shen | 208/89 |
| 4,428,819 | 1/1984 | Shu et al. | 208/111 |
| 4,486,296 | 12/1984 | Oleck et al. | 208/111 |
| 4,490,242 | 12/1984 | Oleck et al. | 208/97 |
| 4,554,065 | 11/1985 | Albinson et al. | 208/59 |
| 4,594,172 | 6/1986 | Sie | 252/55 |
| 4,599,162 | 7/1986 | Yen | 208/59 |
| 4,601,993 | 7/1986 | Chu et al. | 208/111 |
| 4,767,522 | 8/1988 | Yen | 208/111 |

LUBRICANT PRODUCTION PROCESS

FIELD OF THE INVENTION

The present invention relates to a process for the production of lubricants and more particularly, to a process for the production of hydrocarbon lubricants of high viscosity index.

CROSS-REFERENCE TO RELATED APPLICATIONS

This application is a continuation-in-part of application Ser. No. 793,937, filed 1 November 1985, now abandoned, by W. E. Garwood, Q. N. Le and S. S. Wong entitled Lubricant Product Process, the entire disclosure of which is incorporated by this reference. This application is also a continuation-in-part of application Ser. No. 821,125, filed 22 January 1986 which, now abandoned, in turn, was a continuation of application Ser. No. 685,089, filed 21 December 1984, now abandoned, both of these applications being filed by N. Y. Chen and T. J. Huang and entitled Cascade Catalytic Lube Processes. The entire disclosures of Ser. Nos. 821,125 and 685,089 are incorporated in this application by this reference to them.

This application is also related to application Ser. No. 044,187, filed 30 April 1987, now abandoned, to which reference is also made.

BACKGROUND OF THE INVENTION

Mineral oil lubricants are derived from various crude oil stocks by a variety of refining processes. Generally, these refining processes are directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, the use of asphaltic type crudes is not preferred as the yield of acceptable lube stocks will be extremely low after the large quantities of aromatic components contained in such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as phenol, furfural, N-methylpryyolidone (NMP) or another material which is selective for the extraction of the aromatic components. If the lube stock is a residual lube stock, the asphaltenes will first be removed in a deasphalting step e.g. by propane deasphalting, followed by solvent extraction of residual aromatics to produce a lube generally referred to as bright stock. In either case, however, a dewaxing step is normally necessary in order for the lubricant to have a satisfactory low pour point and cloud point, so that it will not solidify or precipitate the less soluble paraffinic components under the influence of low temperatures.

A number of dewaxing processes are known in the petroleum refining industry and of these, solvent dewaxing with solvents such as methylethylketone (MEK) and liquid propane, has been the one which has achieved the widest use in the industry. Recently, however, proposals have been made for using catalytic dewaxing processes for the production of lubricating oil stocks and these processes possess a number of advantages over the conventional solvent dewaxing procedures. The catalytic dewaxing processes which have been proposed are generally similar to those which have been proposed for dewaxing the middle distillate fractions such as heating oils, jet fuels and kerosenes, of which a number have been disclosed in the literature, for example, in Oil and Gas Journal, January 6, 1975, pp. 69–73 and U.S. Pat. Nos. RE 28,398, 3,956,102 and 4,100,056. Generally, these processes operate by selectively craking the longer chain end paraffins to produce lower molecular weight products which may then be removed by distillation from the higher boiling lube stock. The catalyst which have been proposed for this purpose have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, ZSM-35 and ZSM-38 have been proposed for this purpose in dewaxing processes, as described in U.S. Pat. Nos. 3,894,938, 4,176,050, 4,181,598, 4,222,855, 4,229,282 and 4,247,388. A dewaxing process employing synthetic offretite is described in U.S. Pat. No. 4,259,174. The Mobile Lube Dewaxing process (MLDW) is capable of converting high pour point waxy lube oil base stocks by selective cracking over a shape selective catalyst, followed by hydrotreating to saturate lube range olefins so as to stabilize the product. See 1986 Refining Process Handbook (Hydrocarbon Processing, September 1986, Gulf Publ. Co.) page 90 and Catal. Rev. - Sci. Eng. 28 (283), 185–264 (Chen et al), especially 244–247.

Although the catalytic dewaxing processes are commercially attractive because they do not produce quantities of solid paraffin wax which presently is regarded as an undesirable, low value product, they do have certain disadvantages and because of this, certain proposals have been made for combining the catalytic dewaxing processes with other processes in order to produce lube stocks of satisfactory properties. For example, U.S. Pat. No. 4,181,598 discloses a method for producing a high quality lube base stock by subjecting a waxy fraction to solvent refining, followed by catalytic dewaxing over ZSM-5 with subsequent hydrotreatment of the product. U.S. Pat. No. 4,428,819 discloses a process for improving the quality of catalytically dewaxing lube stocks by subjecting the catalytically dewaxed oil to a hydroisomerization process which removes residual quantities of petrolatum wax which contribute to poor performance in the Overnight Cloud Point test (ASTM D2500-66). This process is intended to overcome one disadvantage of the intermediate pore dewaxing catalyst such as ZSM-5 which is that the normal paraffins are cracked much faster that the slightly branched chain paraffins and cycloparaffins so that, although a satisfactory pour point is attained (because the straight chain paraffins are removed) residual quantities of branched chain paraffins and cycloparaffins may be left in the oil, to contribute to a pour performance in the Overnight Cloud Point test when the oil is subjected to a relatively low temperature for an extended period of time. During this time, the petrolatum wax which is made up of the less soluble slightly branched chain paraffins and cycloparaffins, nucleates and grows into wax cyrstals of a sufficient size to produce a perceptible haze. Although it would be possible to remove the petrolatum wax by operating the dewaxing process at a higher conversion so that these components were removed together with the straight chain paraffins, the yield loss which would result, has generally been considered unacceptable. Thus, the need for a subsequent processing step has become apparent.

As mentioned above, the conventional catalytic dewaxing processes using intermediate pore size zeolites such as ZSM-5 operate by selectively cracking the waxy components of the feed. This results in a loss in yield since the components which are in the desired boiling range undergo a bulk conversion to lower boiling fractions which, although they may be useful in other products, must be removed from the lube stock. A notable advance in the processing of lube stocks is described in U.S. Pat. Nos. 4,419,220 and 4,518,485, in which the waxy components of the feed, comprising straight chain and slightly branched chain paraffins, are removed by isomerization over a catalyst based on zeolite beta.

During the isomerization, the waxy components are converted to relatively less waxy isoparaffins and at the same time, the slightly branched chain paraffins undergo isomerization to more highly branched aliphatics. A measure of cracking does take place during the operation so that not only is the pour reduced by reason of the isomerization but, in addition, the heavy ends undergo some cracking or hydrocracking to form liquid range materials which contribute to a low viscosity product. The degree of cracking is, however, limited so as to maintain as much of the feedstock as possible in the desired boiling range. As mentioned above, this process uses a catalyst which is based on zeolite beta, together with a suitable hydrogenation-dehydrogenation component which is typically a base metal or a nobel metal, usually of group VIA or VIIIA of the Periodic Table of the Elements (the periodic table used in this specification is the table approved by IUPAC), such as cobalt, molybdenum, nickel, tungsten, palladium or platinum. As described in U.S. Pat. No. 4,518,485, the isomerization dewaxing step may be proceded by a hydrotreating step in order to remove heteroatom-containing impurities, which may be separated in an interstage separation process similar to that employed in two-stage hydrotreating-hydrocracking processes.

As is apparent from the preceding description, the objective in dewaxing processes is to remove the waxy components of the feed which tend to precipitate out of the liquid oil when it is subjected to low temperatures. These waxy components may generally be characterized as the straight chain and slightly branched chain paraffins of high melting point, especially the mono-methyl paraffins. Generally, the straight chain paraffins must be removed in order to ensure that the oil has a satisfactory low pour point while the slightly branched chain materials need to be removed in order to ensure that the product does not become hazy by the relatively slow growth of the waxy components. If especially low pour points are desired, it may be necessary to remove some of the higher melting point branched chain paraffins such as the mono-methyl paraffins because preferential removal of the n-paraffins will generally lower the pour point at about −18° C. (−28° F.). A countervailing factor, however, is that it is generally undesirable to operate the dewaxing under conditions of relatively high severity because not only does this result in a lower lube yield but, in addition, the isoparaffinic components which contribute to a high viscosity index may be removed together with the waxy components which are more straight chain in character. Thus, a balance must be sought between removing sufficient of the waxy paraffins to obtain the desired pour point and cloud point specifications and the need to retain a sufficient number of the branched chain isoparaffins which contribute to a good viscosity index (VI) in the product. It is, of course, desirable to produce a base stock of high VI since this reduces the need for VI improvers which, besides being expensive, become degraded in use with a resultant deterioration in lubricant properties. The objective of the dewaxing procedure must therefore be to produce a lube stock with an acceptable balance of properties in as high a yield as possible.

SUMMARY OF THE INVENTION

We have devised a process for the production of lubricant base stocks which are characterized by low pour point and high viscosity index. The present process enables these lube stocks to be produced in good yields with the minimum production of undesirable materials such as lighter, cracked products and solid or semi-solid waxes.

According to the present invention, the lube products of high viscosity index are produced by first dewaxing a waxy hydrocarbon feedstock in a catalytic dewaxing operation for partial dewaxing of the feedstock, followed by a dewaxing operation which is selective for the removal of straight chain paraffins. The partial dewaxing which occurs in the first stage maximizes the retention of high VI, isoparaffinic components and also reduces the process requirements for the selective wax removal which occurs in the second stage. The second stage, which selectively removes the residual quantities of the most waxy components, especially the n-paraffins and the branched chain paraffins with only minor degrees of branching with short chain branches, is suitably carried out by using a solvent dewaxing process, such as MEK dewaxing or liquid propane dewaxing or a catalytic dewaxing operation which is highly selective for removal of the relatively more waxy components.

The initial dewaxing to remove the n-paraffins and the branched chain paraffins, is a catalytic dewaxing operation using a dewaxing catalyst comprising a large pore, highly siliceous zeolite such as zeolite Y, zeolite ZSM-20 or zeolite beta, together with a hydrogenation-dehydrogenation component. Dewaxing catalysts of this type have been found to effect a removal of the waxy components by an isomerization process which converts straight chain paraffins to branched chain paraffins. These catalysts are therefore able to increase the concentration of the iso-paraffins, leading to a product of high VI as well as low pour point (ASTM D-97). Zeolite beta is the preferred zeolite in these catalysts.

The extent of the dewaxing which occurs during the first step may be controlled by operating at a severity which reduces the pour point of the feed to no lower than about 10° F. (5.5° C.) higher than the target pour point. Generally, it will be preferred to reduce the pour point of the feedstock to a value which is no lower than 20° F. (11° C.) higher than the target pour point. The minimum amount of dewaxing in the first stage is generally such that the pour point of the feedstock will be reduced by at least about 10° F. (about 5.5° C.), preferably at least about 20° F. (about 11° C.).

THE DRAWINGS

In the accompanying drawings:

FIG. 1 is a graph which illustrates the effect of catalystic dewaxing severity upon the paraffinic content of the feedstock, FIG. 2 is a graph which relates to the pour point of the total liquid product from the catalytic dewaxing step to the severity of the operation, FIG. 3 is a graph which relates the VI of two dewaxed lubricants to the pour point of the intermediate, partly dewaxed product, and FIG. 4 is a graph which relates product VI and yield to the conversion in the initial dewaxing step for a specific feed.

DETAILED DESCRIPTION

General Considerations

The present process operates, as mentioned above, by carrying out a partial removal of the waxy components in an initial catalytic dewaxing step which uses a highly siliceous, large pore zeolite catalyst, preferably zeolite beta. This catalytic dewaxing operation is carried out under conditions which maximize removal of the most waxy components of the feed but minimizes, as far as possible, the removal of the components which contribute to the desired high viscosity index in the product but less to low pour point. Thus, the first dewaxing operation has as its objective, the removal of the straight chain n-paraffins while minimizing the removal of the branched chain isoparaffins. However, because the feedstock will contain a number of isomeric paraffins in the same boiling range, some of which are straight chain, some of which are slightly branched chain (with short chain branches) and some of which are more highly branched, it is not possible to carry out the removal in a completely selective manner. Because of this, some of the less highly branched isoparaffins will be removed together with the n-paraffins and conversely, some of the n-paraffins will remain in the feed until it is subjected to the subsequent, selective dewaxing step in which the n-paraffins are removed. However, because the large pore, high silica zeolite initially remove the n-paraffins in preference to the isoparaffins, the content of isoparaffins in the feed will initially increase. Two reasons may be stated for this: first, because the n-paraffins are being selectively removed from the feed, the concentration of the remaining isoparaffins will proportionately increase. Second, because these catalysts remove the n-paraffins by a process which include isomerization to isoparaffins, the concentration of these components will increase on an absolute basis.

Figure 1:
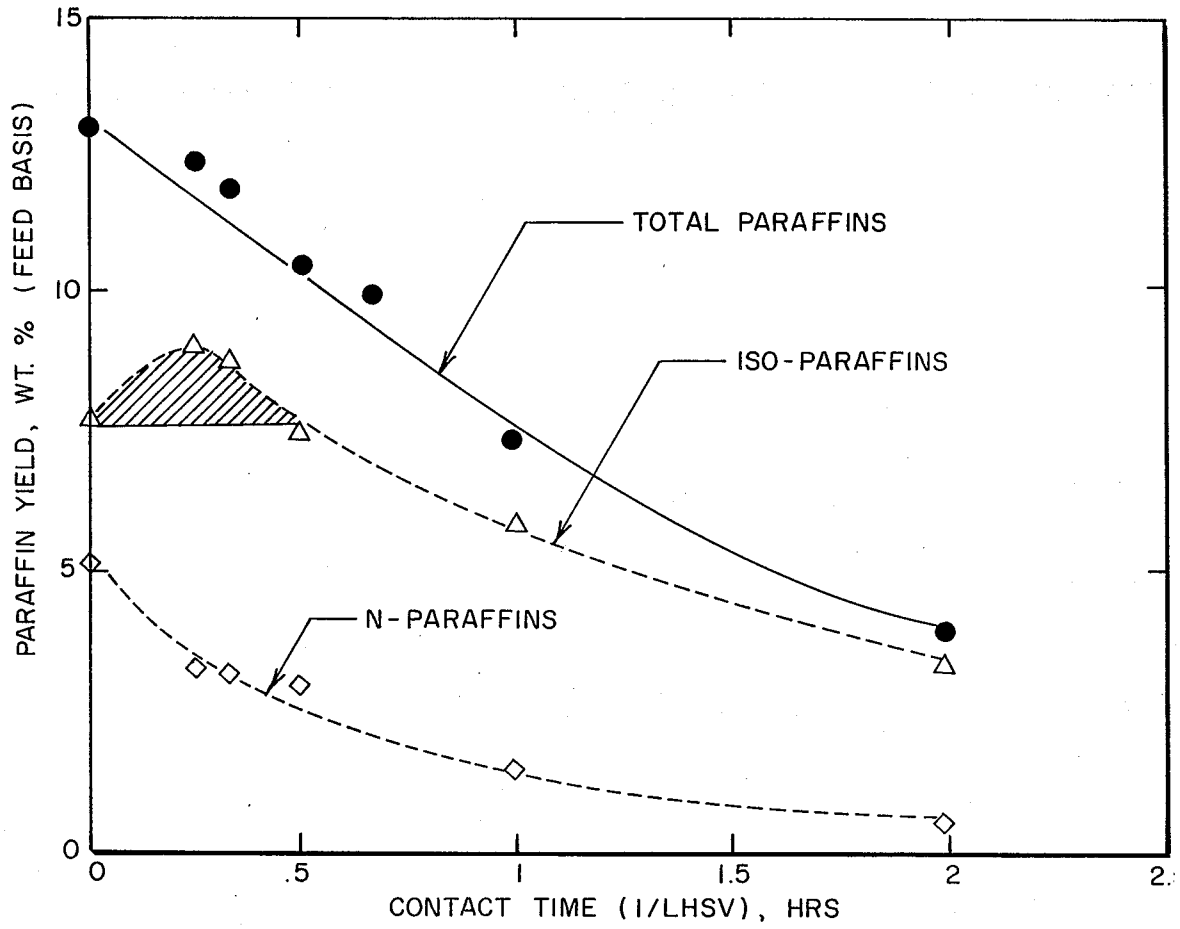
Figure 2:
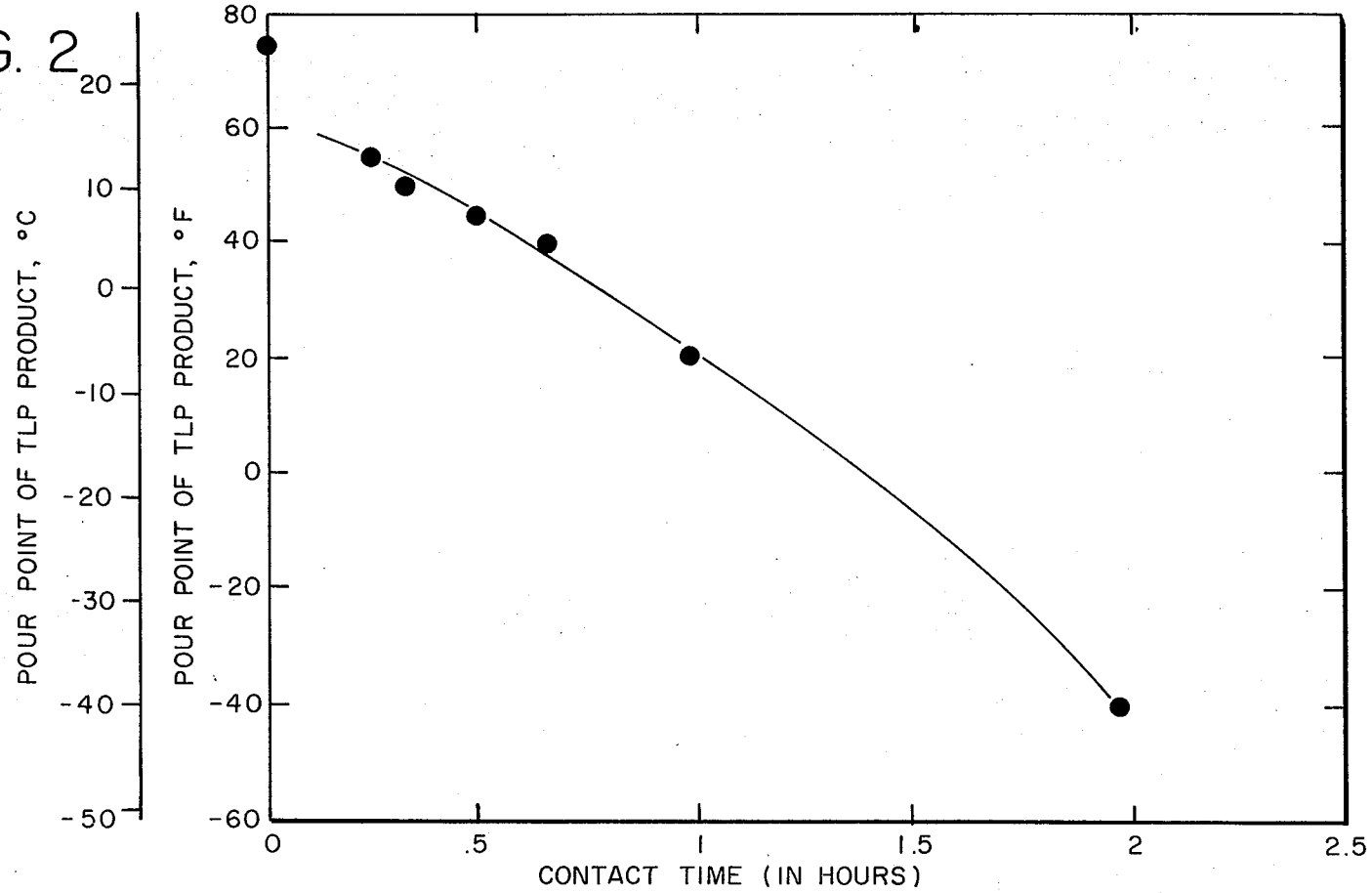

In FIG. 1, which shows the effect of isomerization dewaxing severity, plotted as contact time (1/LHSV, hours) plotted against the paraffin (total, n- and iso-) content of a typical oil, the relative changes in the concentrations of the paraffinic components may be seen. Initially, the catalyst isomerizes the n-paraffins to isoparaffins, so reducing the content of the former and increasing that of the latter, both on an absolute and relative basis. At more extended contact times (increased severity) the catalyst converts the iso-paraffins as well as the n-paraffins so that both decrease together, although at slightly different rates. FIG. 2 shows how the pour point of the total liquid product from the catalytic dewaxing step decreases with increasing oil/catalyst contact time, indicating progressive removal of the n-paraffins, either by isomerization or cracking.

In order to achieve the highest VI in the product, the conditions in the first dewaxing step are chosen to maximize the concentration of iso-paraffins in the product; however, this may not enable the target pour point for the catalyst dewaxing operation to be achieved and so it may be necessary to reduce the content of iso-paraffins below this maximum figure even though this may result in some loss of VI in the product. It may be possible to maximize VI in the product by operating the first dewaxing step under optimum conditions so as to maximize the iso-paraffin content of the catalytically dewaxed effluent, with the balance of the waxy paraffins being removed in the subsequent selective dewaxing step but this will depend upon the product specifications, the nature of the feedstock, the dewaxing capacity of the second dewaxing step, the amount of wax by-product which is acceptable and the extent to which it is possible to optimize conditions in the first catalytic dewaxing step. In any event, however, the present two-stage process offers the potential for productin improved lubricants of high VI and low pour point, cloud point and other properties.

Feedstock

The feedstock for the present process may generally be characterized as a lube fraction prepared from a crude stock of suitable characteristics. In the direct production of lube stocks from crude, the crude will be subjected to various conventional processes such as distillation in atmospheric and vacuum towers in order to obtain a fraction of the requisite boiling point, after which the lube stock will be subjected to removal of the aromatics using a suitable solvent. In the case of the neutral lube fractions, removal of the aromatics will normally proceed by a solvent extraction process using a solvent such as phenol, furfural, NMP or another conventional type of solvent for this purpose. If the lube stock is a residual lube stock, i.e. bright stock, removal of asphaltenes and some aromatics will generally be effected in a deasphalting operation, e.g. a propane deasphalting (PDA) step, as is conventional. After deasphalting, a solvent extraction will be used to reduce the residual aromatics concentration to acceptable levels. After these processes, the lube stock will have a sufficiently low content of aromatic constituents for use as a lube stock; the aromatic components are, of course, undesirable in lubricants because they tend to increase the viscosity while having an extremely adverse effect upon the viscosity index. At this point, the lube stock will typically have a boiling point above the distillate range, i.e. above about 345° C. (about 650° F.) but the lube stock which may be used are generally characterized in terms of their viscosity rather than their boiling ranges since this is a more important characteristic for a lubricant. Generally, if the lube base stock is a distillate base stock, i.e. a neutral stock, it will have a viscosity in the range of 100 to 750 SUS (20 to 160 cSt) at 40° C. (99° F.) and in the case of a bright stock, the viscosity will generally be in the range of 1000 to 3000 SUS (210 to about 600 cSt) at 99° C. (210° F.). The light neutral stocks are generally characterized by their Saybolt viscosity at 40°C., e.g. as a 100 second neutral which has a viscosity of about 100 SUS at 40° C. (20 cSt) a 300 second neutral has a viscosity of 300 SUS at 40° C. (65 cSt) and a heavy neutral will typically have a viscosity of up to about 750 SUS (160 cSt). However, these specific viscosities and viscosity ranges are not critical but will depend upon the appropriate uses for which the lubricants are to be put. They are quoted here as exemplary of the types of lube stocks to which the present process may be applied.

The distillate (neutral base stocks may generally be characterized as paraffininc in character, although they also contain naphthenes and aromatics and because of their paraffininc character, they are generally of fairly low viscosity and high viscosity index. The residual stocks such as bright stock will be more aromatic in character and for this reason will generally have higher viscosities and lower viscosity indices. In general, the aromatic content of the stock will be in the range of 10 to 70 weight percent, usually 15 to 60 weight percent with the residual stocks having the relatively higher aromatic contents, typically 20 to 70 weight percent, more commonly 30 to 60 weight percent and the distillate stocks having lower aromatic contents, for instance, 10 to 30 weight percent. However, as described below certain highly paraffinic feeds containing much higher paraffin contents may be used to great advantage in the process. Fractions in the gas oil boiling range (315° C.+(600° F.+)) with an end point usually below about 565° C. (about 1050° F.) are a convenient feed because they can generally be treated by the present process to produce high quality lubes.

In addition to lube stocks produced directly from crudes, as described above, the present dewaxing process is capable of using other petroleum refinery streams of suitable characteristics and refining them so as to produce lubricants of extremely good properties. In partcular, it is capable of producing lubricants from highly paraffinic refinery streams such as those obtained from the solvent dewaxing of distillates and other lube fractions, commonly referred to as slack wax or de-oiled slack wax. These streams are highly paraffinic in nature and generally will have a paraffin content of at least 50, more usually at least 70, weight percent with the balance from the occluded oil being divided between aromatics and naphthenics. These waxy, highly paraffinic stocks usually have much lower viscosities than the neutral or residual stocks because of their relatively low content of aromatics and naphthenes which are highly viscosity components. The high content of waxy paraffins, however, gives them melting points and pour points which render them unacceptable as lubricants. Because the highly siliceous, large pore zeolite dewaxing catalysts used in the present process are able to isomerize the straight chain and slightly branch-chain paraffins to the less waxy iso-paraffins, they are able to process these highly paraffinic streams into lubricants of extremely good VI. Compositions of some typical slack waxes are given in Table 1 below.

TABLE 1

| Slack Wax Composition - Arab Light Crude | | | | |
|---|---|---|---|---|
| | A | B | C | D |
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

As will be explained below, the zeolites used in the first stage dewaxing catalysts are generally capable of carrying out a certain degree of hydrocracking during the dewaxing. Although this will result in a certain yield loss by conversion to products boiling outside the lubricant boiling range, it also implies that feeds with fairly high contents of aromatics can be tolerated. Thus, fractions derived from crudes which contain high levels of paraffins together with aromatics can be used. However, excessively high aromatic contents should be avoided as they will either give poor yields if the aromatics are removed in the initial dewaxing step or, if not removed, will result in lubricants products with high viscosity and low VI. A typical highly paraffinic fraction which may be treated by the present process to form a high quality, high VI lube is a 345°-540° C. (650°-1000° F.) Minas gas oil having the properties set out in Table 2 below.

TABLE 2

| Minas Gas Oil | |
|---|---|
| Nominal boiling range, °C. (°F.) | 345°-540° (650°-1000°) |
| API Gravity | 33.0 |
| Hydrogen, wt % | 13.6 |
| Sulfur, wt % | 0.07 |
| Nitrogen, ppmw | 320 |
| Basic Nitrogen, ppmw | 160 |
| CCR | 0.04 |
| Composition, wt % | |
| Paraffins | 60 |
| Naphthenes | 23 |
| Aromatics | 17 |
| Bromine No. | 0.8 |
| KV, 100° C., cSt | 4.18 |
| Pour Point, °C. (°F.) | 46 (115) |
| 95% TBP, °C. (°F.) | 510 (950) |

Highly paraffinic feeds such as this will generally have a pour point of at least 40° C.: wax feeds such as slack wax will usually be solid at ambient conditions.

The use of slack wax and de-oiled wax feeds is described in Ser. No. 044,187, to which reference is made for such a description.

Other high boiling fractions which may be used as feeds for the present process include synthetic lubricant fractions derived, for example, from shale oil by by synthesis from natrual gas, coal or other carbon sources. A particularly useful feed is the high boiling fraction obtained from the Fischer-Tropsch synthesis since this contains a high proportion of waxy paraffins which can be converted to highly iso-paraffinic components by the present process.

Thus, the feeds to the present process can generally be said to contain paraffins for their desirable lubricating qualities together with cycloparaffins (naphthenes) and aromatics, usually in lesser quantities. The paraffins, in turn, may be characterized as the straight chain n-paraffins and branched chain, isoparaffins. It is the straight chain paraffins and the slightly branched chain paraffins which make the greatest contribution to the waxy nature of the base stock and the objective of the present process is to remove these waxy components so that the final, dewaxed product has an acceptable pour point and other characteristics, such as cloud point, overnight cloud point, etc. However, because the more highly branched chain isoparaffins confer good viscosity index properties, the objective is to leave these as intact as possible consistent with attaining the desired pour point and other properties. The content of isoparaffins may be increased on an absolute basis by isomerization as well as on a relative basis by removal of the straight chain n-paraffins. Depending upon the relative proportions of these components, the pour point of the base stock prior to dewaxing may vary over a wide range and because the pour points of the various, desired products will vary according to the uses to which the lubricants will be put, the degree of dewaxing will necessarily vary. In addition, certain lube products will require a certain minimum VI and consideration of this factor may affect the extent to which dewaxing is carried through, especially during the catalytic dewaxing step because if this is operated under conditions of excessive severity, the isoparaffinic components which contribute to high VI may be removed, with a consequent adverse effect on product VI.

It will generally be preferred to hydrotreat the feed before the first stage dewaxing in order to remove heteroatom containing impurities and to hydrogenate at least some of the aromatics which may be present to form naphthenes. In organic nitrogen and sulfur formed during the hydrotreating may be removed by a conventional separation prior to the catalytic dewaxing. Conventional hydrotreating catalysts and conditions are sutiably used. Catalysts typically comprise a base metal hydrogenation component such as nickel, tungsten, cobalt, nickel-tungsten, nickel-molybdenum or cobalt-molybdenum, on an inorganic oxide support of low acidity such as silica, alumina or silica-alumina, generally of a large pore, amorphous character. Typical hydrotreating conditions use moderate temperatures and pressures, e.g. 290°–425° C. (about 550°–800° F.), typically 345°–400° C. (about 650°–750° F.), up to 20,000 kPa (about 3000 psig), typically about 4250–14000 kPa (about 600–2000 psig) hydrogen pressure, space velocity of about 0.3–2.0, typically 1 LHSV, with hydrogen circulation rates typically abuut 600–1000 $n.l.l.^{-1}$ (about 107 to 5617 SCF/Bbl) usually about 700 $n.l.l.^{-1}$ (about 3930 SCF/Bbl). The severity of the hydrotreating step should be selected according to the characteristics of the feed; the objectives being to reduce residual aromatic content by saturation to form naphthenes so as to make initial improvements in lube quality by removal of aromatics and formation of naphthenes, as well as to remove heteroatom-containing impurities, especially sulfur, in order to improve the color and oxidative stability of the final lube products. The hydrotreating severity will therefore usually be greater with residual lube stocks such as bright stock because of their relatively high aromatic and sulfur contents; synthetic lube stocks such as Fischer-Tropsch fractions which are relatively high in nitrogen may also need comparatively severe hydrotreating to remove contaminents.

First Stage Dewaxing

In the first step of the present process, the lube base stock is subjected to catalytic dewaxing by isomerization over a large pore, highly siliceous zeolite catalyst. Although isomerization does not require hydrogen for stoichiometric balance, the presence of hydrogen is desirable in order to promote certain steps in the isomerization mechanism and also to maintain catalyst activity. Also, because the isomerization steps entail hydrogenation and dehydrogenation, the catalyst will contain a hydrogenation-dehydrogenation component in addition to the zeolite. The hydrogenation-dehydrogenation component (referred to, for convenience, as a hydrogenation component) is generally a metal or metals of groups IB, IVA, VA, VIA, VIIA or VIIIA of the Periodic Table, preferably of Groups VIA or VIIIA and may be either a base metal such as cobalt, nickel, vanadium, tungsten, titanium or molybdenum or a noble metal such as platinum, rhenium, palladium or gold. Combinations of base metals such as cobalt-nickel, cobalt-molybdenum, nickel-tungsten, cobalt-nickel-tungsten or cobalt-nickel-titanium may often be used to advantage and combinations or nobel metals such as platinum-palladium may also be used, as may combinations of base metals with nobel metals, such as platinum-nickel. These metal components may be incorporated into a catalyst by conventional methods such as impregnation using salts of the metals or solutions of soluble complexes which may be cationic, anionic or neutral in type. The amount of the hydrogenatin component is typically from 0.01 to 10% by weight of catalyst with the more highly active noble metals being used at lower concentrations, typically from 0.1 to 1% whereas the base metals are normally present in relatively higher concentrations e.g. 1 to 10%.

In addition to the hydrogenation component, a large pore, highly siliceous zeolite is present as an acidic component of the catalyst. The large pore zeolites which may be used in the catalysts of the initial dewaxing step are characterized by a porous lattice structure which possesses pores having a minimum dimension of at least 6 A°. In addition, the zeolites have a structural silica:alumina ratio of 10:1 or more, preferably much higher, for example, 20:1, 30:1, 50:1, 100:1, 200:1, 500:1 or even higher. Zeolites of this type may also be characterized in terms of their Constraint Index and hydrcarbon sorption capacity.

Zeolites have a crystal structure which is capable of regulating the acess to an egress from the intracrystalline free space. This control, which is effected by the crystal structure itself, is dependent both upon the molecular configuration of the material which is or, alternately, is not, to have access to the internal structure of the zeolite and also upon the structure of the zeolite itself. A convenient measure of the extent to which a zeolite provides this control for molecules of varying sizes to its internal structure is provided by the Constraint Index of the zeolite; zeolites which provide highly restricted access to and egress from the initial structure have a high value for the Constraint Index and zeolites of this kind usually have pores of small size. In contrast, zeolites which provide relatively free access to the internal zeolite structure have a low value for the Constraint Index. The method by which Constraint Index is determined is described fully in J. Catalysis 67, 218–222 (1981) and in U.S. Pat. No. 4,016,218 to which reference is made for details of the method together with examples of Canstraint Undex for some typical zeolites. Because Constraint Index is related to the crystalline structure of the zeolite but is nevertheless determined by means of a test which exploits the capacity of the zeolite to engage in a cracking reaction, that is, a reaction dependent upon the possession of acidic sites and functionality in the zeolite, the sample of zeolite used in the test should be representative of zeolite structure whose Constraint Index is to be determined and should also possess requisite acidic functionality for the test. Acidic functionality may, of course, be varied by artifices including base exchange, steaming or control of silica:alumina ratio.

Consistent with the minimum pore size limitation mentioned above the zeolites used in the initial dewaxing step should have a Constraint Index in the range of up to 2.0 and usually, the Constraint Index will fall in the range 0.5 to 2.0. Because the isomerization selectivity becomes lower with smaller pore size in the zeolite, the larger pore materials which conform to these limitations will be preferred. Zeolites which may be used in the process include zeolite Y, zeolite beta, mordenite and zeolites ZSM-12, ZSM-20 and ZSM-50. Zeolite ZSM-12 is described in U.S. Pat. No. 3,832,499; ZSM-20 in U.S. Pat. No. 3,972,983; ZSM-50 in U.S. patent application Ser. No. 343,631 and highly siliceous forms of ZSM-12 are described in European Patent Application No. 0,013,630, to which reference is made for details of those zeolites and their preparation.

Another property which characterizes the zeolites which may be used in the catalysts is their hydrocarbon sorption capacity. The zeolite used in the catalysts should have a hydrocarbon sorption capacity for n-hexane of greater than 5 preferably greater than 6 percent by weight at 50° C. The hydrocarbon sorption capacity is determined by measuring the sorption at 50° C., 2666 Pa hydrocarbon pressure in an inert carrier such as helium:

$$\text{Hydrocarbon sorption capacity (\%)} = \frac{\text{Wt. of hydrocarbon sorbed}}{\text{Wt. of zeolite}} \times 100$$

The sorption test is conveniently carried out in a TGA with helium as a carrier gas flowing over the zeolite at 50° C. The hydrocarbon of interest, for example n-hexane is introduced into the gas stream adjusted to 20 mm Hg hydrocarbon pressure and the hydrocarbon uptake, measured as the increase in zeolite weight is recorded. The sorption capacity may then be calculated as a percentage.

If the zeolite selected may be produced in the desired highly siliceous form by direct synthesis, this will often be the most convenient method for obtaining it. Zeolite beta, for example, is known to be capable of being synthesized directly in forms having silica:alumina ratios up to 200:1, as described in U.S. Pat. Nos. 3,308,069 and RE 28,341 which describe zeolite beta, its preparation and properties in detail. Zeolite Y, on the other hand, can be synthesized only in forms which have silica:alumina ratios up to about 5:1 and in order to achieve higher ratios, resort may be made to various techniques to remove structural aluminum so as to obtain a more highly siliceous zeolite. The same is true of mordenite which, in its natural or directly synthesized form has a silica:alumina ratio of about 10:1. Zeolite ZSM-20 may be directly synthesized with silica:alumina ratios of 7:1 or higher, typically in the range of 7:1 to 10:1, as described in U.S. Pat. Nos. 3,972,983 and 4,021,331 to which reference is made for details of that zeolite, its preparation and properties. Zeolite ZSM-20 also may be treated by various methods to increase its silica:alumina ratio.

Control of the silica:alumina ratio of the zeolite in its as-synthesized form may be exercized by an appropriate selection of reaction conditions, as appropriate to the zeolite in question. If, however, the zeolite cannot readily be synthesized directly with the desired high silica:alumina ratio, various dealuminization techniques may be employed with many zeolites to increase the ratio to the desired level. Exemplary techniques of this kind of disclosed in U.S. patent application Ser. No. 379,423, filed 18 May 1982 and its counterpart, EU No. 94,826, to which reference is made for a detailed description of these techniques.

The preferred zeolite for the dewaxing catalyst used in the first stage is zeolite beta. Zeolite beta is a known zeolite which is described in U.S. Pat. Nos. 3,308,069 and RE 28,341, to which reference is made for further details of this zeolite, its preparation and properties. The preferred forms of zeolite beta for use in the present process are the high silica forms, having a silica alumina ratio of at least 30:1 and it has been found that ratios of at least 50:1 or even higher, for example, 100:1, 250:1, 500:1, may be used to advantage because these forms of the zeolite are less active for cracking than the less highly siliceous forms so that the desired isomerization reactions are favored at the expense of cracking reactions which tend to effect a bulk conversion of the feed, forming cracked products which are outside the desired boiling range for lube components. Suitable catalysts for use in the present process are described in U.S. Pat. Nos. 4,419,220 and 4,518,485, to which reference is made for a more detailed description of these zeolite beta based catalysts. As mentioned in these two patents, the silica:alumina ratios referred to in this specification are the structural or framework ratios and the zeolite, whatever its type, may be incorporated into a matrix material such as clay, silica or a metal oxide such as alumina or silica alumina.

The large pore, high-silica zeolites used in the initial dewaxing step act by isomerizing the long chain waxy paraffins in the feed to form iso-paraffins which are less waxy in nature but which possess a notably high viscosity index. At the same time, the zeolites will promote a certain degree of cracking or hydrocracking so that some conversion to products outside the lube boiling range will take place. This is not, however, totally undesirable because if significant quantities of aromatics are present in the feed they will tend to be removed by hydrocracking, with consequent improvements in the viscosity and VI of the product. The extent to which cracking reactions and isomerization reactions will predominate will depend on a number of factors, principally the nature of the zeolite, its inherent acidity, the severity of the reaction (temperature, contact time) and, of course, the composition of the feedstock. In general, cracking will be favored over isomerization at higher severities (higher temperature, longer contact time) and with more highly acidic zeolites. Thus, zeolites of higher silica:alumina ratio, being less acidic, will generally favor isomerization and therefore will normally be preferred, except possibly to handle more highly aromatic feeds. The acidity of the zeolite may also be controlled by exchange with alkali metal cations, especially sodium, in order to control the extent to which isomerization occurs relative to cracking. The extent to which isomerization will be favored over cracking will also depend upon the total conversion, itself a factor dependent upon severity. At high conversions, typically over about 80 volume percent, isomerization may decrease fairly rapidly at the expense of cracking; in general, therefore, the total conversion by all competing reactions should normally be kept below about 80 volume percent and usually below about 70 volume percent.

The relationships between cracking reactions and isomerization reactions for these zeolites are described in some greater detail in U.S. patent application Ser. No. 183,399, filed 13 Arpil 1988 and its counterpart EU No. 94,826, to which reference is made for such a description.

Although, as mentioned above, zeolite beta is the preferred zeolite because of its high selectivity for isomerization over cracking, it may be desirable in some cases to use a zeolite which is less selective. With feeds which contain significant quantities of polycyclic aromatics such as bright stock, the zeolites with a relatively more open-pored structure such as zeolite Y may be preferred because they will accept these aromatics and promote their removal by the characteristic hydrocracking reactions. Zeolite beta, by contrast, has a higher degree of shape selectivity and is somewhat less accessible in its internal pore structure to bulky aromatics but it does have notable selectivity for isomerization reactions in which it acts upon straight chain and slightly branched chain paraffins in preference to the more highly branched chain paraffins, cycloaliphatics and any aromatics which may be present in the feed. It is extremely effective at isomerizing the relatively straight chain materials to more highly branched chain materials so that it not only effects a dewaxing by the removal of these materials, but also an improvement in viscosity index by the production of the more highly branched chain isoparaffins.

The choice of zeolite may, however, be complicated by other factors besides those just mentioned. Although the larger pore zeolites such as zeolite Y are more effective for removal of aromatics by hydrocracking to produce a product of low viscosity, these same zeolites tend to concentrate the waxy paraffins in the product because of their preference for acting on the aromatics; because of this, these zeolites will tend to raise the pour point of the product, in which case, it may be preferable to use zeolite beta which, although it tends to leave the aromatics alone (thereby raising the viscosity of the product), does act upon the paraffins to that the product pour point is markedly reduced. Thus, depending upon the nature of the feed and the product characteristics, one or the other zeolite may be preferred. Combinations of zeolites, e.g. Y plus beta may be resorted to in order to exploit the desirable characteristics of each, with the ratio between them being selected according to the extent that their individual characteristics are needed.

The selection of the metal hydrogenation-dehydrogenation component will also have a bearing on the relative balance of reactions. The more highly active noble metals, especially platinum, promote hydrogenation-dehydrogenation reactions very readily and therefore tend to promote isomerization at the expense of cracking because paraffin isomerization by a mechanism involving dehydrogenation to olefinic intermediates followed by hydrogenation to the isomer products. The less active base metal, by contrast, will tend to favor hydrocracking and therefore may commend themselves when it is known that cracking reactions may be required to produce a product of the desired properties, e.g. with aromatic feeds such as bright stock. Base metal combinations such as nickel-tungsten, cobalt-molybdenum or nickel-tungsten-molybdenum may be especially useful in these instances.

First Stage Dewaxing Conditions

The catalytic dewaxing in the first stage is carried out under conditions which promote the desired removal of the long chain, waxy paraffinic components, whether by isomerization to iso-paraffins or otherwise, as by cracking. At the same time, other desired and undesired reactions may take place to varying degrees, depending upon the conditions selected. For example, with feeds with a pronounced aromatic character, it may be desirable to promote hydrocracking so as to remove the aromatics even at the expense of the resulting yield loss which will ensue, both by aromatics hydrocracking but also by the more or less inevitable paraffin cracking which will accompany it. Thus, the reaction conditions selected in any given case will depend upon a number of factors and the manner in which they interact with one another. The principle factors will be the nature of the feed and the characteristics desired in the product. Depending upon these factors, the catalyst and other reaction conditions may be selected. The effect of catalyst choice and reaction conditions will be generally as described above, namely, that the more highly acidic zeolites and higher reactions severities will tend to promote hydrocracking reactions over isomerization and that total conversion and choice of hydrogen-dehydrogenation component will also play their parts. Because these will interact in divers ways to affect the result, it is possible here to give no more than this broad indication of what type of result may be obtained from any given selection among the available variables.

Generally, the conditions may be described as being of elevated temperature and pressure. Temperatures are normally from 250° C. to 500° C. (about 480° to 930° F.), preferably 400° to 450° C.) (about 750° to 850° F.) but temperatures as low as 200° C. may be used for highly paraffinic feedstocks. Because the use of lower temperatures tends to favor the desired isomerization reactions over the cracking reactions, the lower temperatures will generally be preferred although it should be remembered that since the degree of cracking which will to some extent inevitably take place will be dependent upon severity, a balance may be established between reaction temperature and average residence time in order to achieve an adequate rate of isomerization while minimizing cracking. Pressures may range up to high values, e.g. up to 25,000 kPa (3,600 psig), more usually in the range 4,000 to 10,000 kPa (565 to 1,435 psig). As shown below, higher lube yield is generally asociated with relatively low hydrogen pressures e.g. below 1000 psig (7000 kPa), especially at greater dewaxing scarcity. Space velocity (LHSV) is generally in the range of 0.1 to 10 $hr.^{-1}$, more usually 0.2 to 5 $hr.^{-1}$. The hydrogen:feed ratio is generally from 50 to 1,000 $n.l.l.^{-1}$ (about 280 to 5617 SCF/bbl), preferably 200 to 400 $n.l.l.^{-1}$ (about 1125 to 2250 SCF/Bbl). Net hydrogen consumption will depend upon the course of the reaction, increasing with increasing hydrocracking and decreasing as isomerization (which is hydrogen-balanced) predominates. The net hydrogen consumption will typically be under about 40 $n.l.l.^{-1}$ (about 224 SCF/Bbl) with feeds of relatively low aromatic content such as the paraffininc neutral (distillate) feeds and slack wax and frequently will be less, typically below 35 $n.l.l.^{-1}$ (about 197 SCF/Bbl); with feeds which contain higher amounts of aromatics, especially the residual lube stocks such as bright stock, higher net hydrogen comsumptions should be anticipated, typically in the range of 50–100 $n.l.l.^{-1}$ (about 280–560 SCF/Bbl), e.g. from 55–80 (about 310–450 SCF/Bbl). Process configuration will be as described in U.S. Pat. Nos. 4,419,220 and 4,518,485, i.e. with downflow trickle bed operation being preferred.

With highly paraffinic feeds of low aromatic content, such as slack wax, it will be desirable to maximize isomerization over hydrocracking and therefore relatively low temperatures, e.g. from 250° to 400° C. (about 480° to 750° C.) will be preferred together with relatively low severities, e.g. space velocities (LHSV) of about 1 to 5, and catalysts of relatively low acidity. Also, zeolite beta will be the zeolite of choice because of its high selectivity for isomerization of the waxy paraffins to iso-paraffins although the other zeolites such as zeolite Y may be tolerated because their characteristic preference for attacking the aromatics (thereby affecting a concentration of paraffins) is of no moment with a feed which is essentially wholly paraffinic. Nobel metal components, especially platinum, will be favored for the same reasons. On the other hand, with feeds of relatively high aromatic content such as bright stock and particularly when it is desired to produce a lubricant of low viscostiy—implying a low aromatic content—the conditions will be selected to obtain more hydrocracking: higher temperatures, e.g. 350° to 450° C. (about 650° to 850° F.), lower space velocities, e.g. 0.1 to 1 and more acidic catalysts of relatively larger pore size, e.g. zeolite Y, with base metal hydrogenation-dehydrogenation components such as nickel-tungsten or cobalt-molybdenum, will be preferred. In both cases, temperatures above about 315° C. (about 600° F.) are preferred in order to obtain the degree of conversion which is necessary.

As mentioned above, the conversion will normally be selected according to the nature of the feed and the zeolite in the catalyst. For example, with feeds of relatively high aromatic content, e.g. bright stock, and a relatively large pore catalyst such as zeolite Y which acts preferentially on the aromatics, the conversion level will have to be higher in order to achieve a given pour point reduction, e.g. 10° F., than with zeolite beta which acts preferentially on the waxy paraffins, simply in order to get the zeolite Y to the point where it starts removing the paraffins. Conversely, if reduction in pour point is not a problem, but reduction in viscosity is, a catalyst based on zeolite beta may have to be operated at a higher conversion level than a zeolite Y-based catalyst in order to get the zeolite beta to the point where it will start to remove the aromatics in the feed, after it has acted on the paraffins. With feeds which are highly paraffinic in nature where aromatics removal is no problem, catalysts based on zeolite Y and other relatively large pore zeolites may be used, although their lower selectivity for isomerization means that lower yields will be obtained for a given reduction in pour point; lube yield efficiency is therefore lower than with zeolite beta.

The extent of the conversion to products boiling outside the lube boiling range, i.e. usually below 345° C. (about 650° F.), will therefore vary according to the nature of the feed and the severity of the operation conditions. With highly paraffinic feeds which are dewaxed in this stage under relatively mild conditions so as to favor isomerization at the expense of hydrocracking, a certain degree of conversion will occur as a result of the isomerization at the n-paraffins at the lower end of the lube boiling range are isomerized to the relatively lower boiling iso-paraffins; at the same time, the cracking type reactions which occur simultaneously especially with any aromatics which are present, will effect a rather greater bulk conversion to lower boiling products. If the feed it a relatively aromatic feed such as bright stock, the dewaxing conditions will be rather more severe so as to promote the hydrocracking reactions which remove the aromatics and the conversion will be correspondingly higher. As a general guide, the bulk conversion to products outside the lube boiling range will be at least 10 weight percent and usually in the range 10 to 50 weight percent, depending upon the characteristics of the feed, the properties desired for the product and the desired product yield. With most feeds it will be found that there is an optimum conversion for VI efficiency, or yield efficiency, that is, for maximum VI relative to yield or maximum yield and in most cases, this will be in the range of 10–50 weight percent conversion, more commonly 15–40 weight percent conversion, as illustrated for typical cases in FIGS. 3 and 4.

Selection of the severity of the dewaxing operation is an important part of the present process because, as mentioned above, it is not possible to remove the straight chain and slightly branched chain waxy components in a completely selective manner, while retaining the desirable more highly branch chain components which contribute to high VI in the product. For this reason, the degree of dewaxing which is achieved in the first step, is limited so as to leave a residual quantity of waxy components which are then removed in the second step. The object of maximizing the isoparaffinic content of the effluent from the catalytic dewaxing step so as to obtain the highest VI in the final product may be achieved by adjusting the severity of the initial dewaxing operation until the optimum conditions are reached for this objective. As the contact time between the catalyst and the feed is extended, the catalyst will effect some cracking besides the desired paraffin isomerization reactions so that the iso-paraffins which are formed by the isomerization reactions as well as the isoparaffins originally present in the feed will become subjected to conversion as the contact time becomes longer (see FIG. 1). Thus, once catalyst type and temperature are selected, the most significant variable in the process from the point of view of producing the products with the best balance of qualities is the contact time between the feed and the catalyst, relative to catalytic activity. Again, because the catalyst will age as the process continues, the optimum contact time will need to be varied itself as a function of increasing operation duration. As a general guide, the contact time (1/LHSV) under typical conditions will generally be less than 0.5 hours in order to maximize the isoparaffinic content of the catalytically dewaxed effluent. However, if lower pour points are desired, longer contact times, typically up to one hour may be employed and in cases where an extreme reduction in pour point is desired, up to two hours.

Although the process is best characterized in terms of the effects which are achieved at each step, practical considerations may dictate that somewhat less than optimum conditions be used in order to minimize analytical work. As a general guide, the minimum amount of dewaxing which occurs during the initial dewaxing step should be such that the pour point of the catalytically dewaxed effluent is reduced by at least 10° F. (5.5° C.) and preferably by at least 20° F. (11° C.). The maximum amount of dewaxing in the initial dewaxing step should be such that the pour point of the first stage effluent is not lower than 10° F. (5.5° C.), preferably 20° F. (11° C.), above the target pour point for the desired product. This range of partial dewaxing by isomerization will generally be found to maximize isoparaffin production so as to produce a produdt of low pour point with a high VI. However, these figures are given as a general guide and naturally, if feeds of extremely high pour point such as slack wax, paraffin wax or petrolatum are used, or if the target pour point for the product is extremely low, it may be necessary or desirable to depart from these approximate figures. Generally, many feeds will have pour points in the range of about 25° to 90° C. (about 75° to 195° F.) unless, like slack wax, they are solid at ambient temperatures. Product pout points are generally in the range −5° to −55° C. (about 23° to −67° F.) and it is therefore usually possible to carry out the dewaxing steps within the limits set out above.

It is generally preferred that the first dewaxing stage should be operated under conditions which reduce the pour point to a value no lower than about +50° F. (+10° C.), preferably no lower than +70° F. (+21° C.), although lower intermediate pour point values may be desirable with certain stocks in order to obtain the highest product V.I. For example, as shown below, maximum product V.I. is obtained with the Minas and Staffjord crude sources when the intermediate pour point (after the first stage) is between about 40° F. (4° C.) and 70° F. (21° C), although a somewhat wider variation is permissible with the relatively less waxy feeds e.g. Staffjord than the more waxy ones where the product V.I. is highly dependent on the intermediate pour point.

The effluent from the first stage dewaxing step may be subjected to fractionation to separate lower boiling fractions out of the lube boiling range, usually 345° C− (about 650° F.), before passing the intermediate product to the second stage, selective dewaxing although cascade operation will often be preferred i.e. no interstage separation. Removal of the lower boiling products, together with any inorganic nitrogen and sulfur formed in the first stage is preferred in order to facilitate control of the pour point of the second stage product if solvent dewaxing is used.

Selective Dewaxing

The effluent from the initial catalytic dewaxing step still contains quantities of the more waxy straight chain, n-paraffins, together with the higher melting non-normal paraffins. Because these contribute to unfavorable pour points, and because the effluent will have a pour point which is above the target pour point for the product, it is necessary to remove these waxy components. To do this without removing the desirable isoparaffinic components which contribute to high VI in the product, a selective dewaxing step is carried out. This step removes the n-paraffins together with the more highly waxy, slightly branched chain paraffins, while leaving the more branched chain iso-paraffins in the process stream. Conventional solvent dewaxing processes may be used for this purpose because they are highly selective for the removal of the more waxy components including the n-paraffins and slightly branched chain paraffins, as may catalytic dewaxing processes which are more highly selective for removal of n-paraffins and slightly branched chain paraffins.

Solvent Dewaxing

Two types of solvent dewaxing processes have become predominant in the industry. The first is the ketone dewaxing process which employs a ketone such as acetone, methylethyl ketone (MEK) or methylisobutyl ketone as a solvent, either on its own or in combination with an aromatic solvent such as benzene, toluene or naphtha. The solvent is mixed with the oil after which the mixture is chilled, using a scraped surface heat exchange or, alternatively, mixing and chilling are accomplished simultaneously by injecting a cold solvent into the oil at a number of points along a cooling tower through which the waxy oil is passing. Scrape surface heat exchangers may be used for additional cooling. Another principal type of process now in use is the autorefrigerant process in which a low molecular weight volatile hydrocarbon such as propane which is a gas at normal temperatures and pressures is used as the solvent. The autorefrigerant solvent is added to the waxy oil as a liquid, under pressure. It is then allowed to evaporate and in so doing cools the mixture, causing the wax to separate. The disadvantage of this process compared to the ketone processes is that the relatively high solubility of wax in the autorefrigerant in any given temperature does not permit the removal of as much wax as is achieved with the ketone dewaxing processes at the same filtration temperature. The pour point of the dewaxed oil is therefore higher for a given filtration temperature and this means that the oil must be chilled to substantially lower temperatures than in ketone dewaxing processes in order to achieve a specified wax content or pour point. Dual solvent systems have also be proposed, for example, in U.S. Pat. No. 3,503,870, using a ketone as well as an autorefrigerant such as propane or propylene. The ketone has the effect of acting as an antisolvent by reducing the solubility of the wax in the autorefrigerant, thereby avoiding one of the disadvantages of the autorefrigerant system and in addition, the evaporative cooling provided by the autorefrigerant minimizes the reliance on scraped heat exchanges, thereby avoiding a major disadvantage of the ketone dewaxing system. However, any of these processes which affect a selective removal of the more highly waxy components of the feed, specifically the straight chain n-paraffins and the more waxy slightly branched chain paraffins may be used in the present process to reduce the pour point of the catalytically dewaxed product to the target pour point for the product.

The wax by-product from the solvent dewaxing may be recycled to the process to increase the total lube yield. If necessary, the slack wax by-product may first be de-oiled to remove aromatics concentrated in the oil fraction and residual heteroatom-containing impurities. Zeolite beta will generally be the preferred catalyst for the initial dewaxing step when there is recycle of the wax by-product from the solvent dewaxing, in order to maximize isomerization of the n-paraffins in the wax.

Selective Catalytix Dewaxing

As an alternative to solvent dewaxing, the second dewaxing step may employ a catalytic dewaxing process which is selective for removal of the n-paraffinx and the slightly branched chain paraffins. Use of a process of this kind will achieve the desired objective of removing the residual waxy components while leaving the desirable iso-paraffins in the product. Catalytic dewaxing processes employ zeolite dewaxing catalysts with a high degree of shape selectivity so that only linear (or almost linear) paraffins can enter the internal structure of the zeolite where they undergo cracking to effect their removal.

Because the objective of this step is to remove the waxy components which contribute to undesirably high pour point while retaining the iso-paraffinic components which contribute to high VI, the dewaxing catalyst should be selected with a view to this end. It has been found that the dewaxing selectivity of zeolitic dewaxing catalysts (as between normal paraffins and branched chain paraffins) is a function of the zeolite structure but is not wholly predictable, at least on the basis of a more general knowledge of the structure of the zeolite. Because dewaxing takes place by selective cracking reactions within the internal pore structure of the zeolite, it would be expected that the zeolites which permitted rather constrained across to their internal pore structures, so that only the n-paraffins and perhaps the slightly branched chain paraffins, e.g. the mono methyl paraffins, could enter, would provide the requisite selective dewaxing. With certain qualifications, this is so: as explained below, the more constrainbed intermediate pore size zeolites such as ZSM-22 and ZSM-23 (Constraint Indices above 8) are highly selective for removal of the waxiest components, but this is not the sole qualification as it has been found that certain zeolites which would be expected to offer less constrained access to their internal pore structures are also highly effective as selective dewaxing catalysts for the purpose of the present process. As an example of the phenomenon, the synthetic zeolite TMA-offretite has been found to offer a high degree of selectivity for removal of n-paraffins, as described in J. Catalysis 86, 24–31 (1984), to which reference is made for a description of its performance in this respect. As described there, TMA-offretite has a Constraint Index of 3.7 but is more selective for dewaxing by n-paraffin removal than ZSM-5 (C.I.=8.3). It has also been found that the synthetic ferrierite type material zeolite ZSM-35 (C.I.=4.5) is highly selective for n-paraffin removal. Furthermore, it has also been found that certain eolites which would not be expected, on the basis of their structure, to be at all selective in their dewaxing properties, may in fact be quite effective for selective dewaxing when combined with a suitable metal function. In this respect, the dense phase, clathrate type zeolite ZSM-39 has been found to be an effective shape selective dewaxing catalyst when combined with platinum as a metal, as described in U.S. patent application Ser. Nos. 629,139, filed 18 July 1984, and 036,825 filed 10 April 1987 of W. E. Garwood et al to which reference is made for a description of the selective dewaxing process using PT/ZSM-39.

With these considerations in mind, therefore, it can be seen that the highly selective dewaxing which is desired in this stage of the process is best described by reference to the nature of the results produced by the use of a particular catalyst than by reference to the nature of the catalyst itself. In general, the dewaxing catalyst used in this step should be at least as selective for n-paraffin and slightly branched chain paraffin removal as zeolite ZSM-5 and preferably is more selective than ZSM-5 in this respect.

The selectivity of a dewaxing catalyst may be determined by the method described in J. Catalyst 86, 24–31 (1984) to which reference is made for a description of the method. In brief, a feedstock is catalytically dewaxed over the zeolite of interest with varying severities to achieve different product pour points. The conversion required to achieve a given degree of dewaxing may then be compared with those of ZSM-5, for example, by graphical comparison, to determine the relative selectivity. As described in the article, TMA-offretite is more selective than ZSM-5 as shown by the fact that it achieves lower product pour points at lower conversions, i.e. dewaxing severities. Although the suitability of a particular zeolite for selective dewaxing may generally be determined by using a standard of a model feed, it may be preferred to determine the selectivity of the catalyst with the feed which it will be required to handle in the actual dewaxing process, i.e. the first stage effluent, in order to make a complete assessment of the selectivity in the face of competing reactions arising from the presence of other components in the second stage feed. To make the most exact comparison, not only the feed but also the conditions to be encountered in the selective dewaxing step should be replicated. Thus, the comparison should be made with the revelant feed and under the appropriate conditions of severity which will give the conversion necessary to achieve the desired product pour point. In this respect, it should be noted that a solvent dewaxing will be at least as selective as ZSM-5 at a given pour point reduction for a given feed since it removes only those waxy components necessary to reduce the pour point to the target value and no others whereas ZSM-5 usually participates in some non-selective dewaxing, especially at lower target pour points which imply higher dewaxing conversions.

The zeolite which are considered, on the basis of simple structural considerations, to have the greatest potential for the highly selective dewaxing required in the second step are the more highly constrained intermediate pore size zeolites which impose a high degree of restraint in permitting hydrocarbon molecules access to their interior pore structure. The Constraint Indices of these zeolites should be at least about 8 and in addition, they preferably have a hydrocarbon sorption of less than 10, preferably less than 5, weight percent for n-hexane and preferably less than 5 weight percent for cyclohexane (sorption measured at 50° C. 2666 Pa hydrogen pressure, as described above). Because of the characterization of these zeolites as being of intermediate pore size, the Constraint Index will normally be between 8 and 12. Zeolites of this kind are the relatively smaller pore intermediate pore size zeolites such as ZSM-22 and ZSM-23, which typically have Constraint Indices of about 9, n-hexane sorptions of about 4.5 and cyclohexane sorptions of about 2.9. Zeolite ZSM-22 is disclosed in U.S. Pat. No. 4,481,177 as well as U.S. patent application Ser. Nos. 373,451 and 373,452, both filed 30 April 1982 and U.S. Pat. No. 4,481,177; zeolite ZSM-23 is disclosed in U.S. Pat. No. 4,076,842 ZSM-35 is disclosed in U.S. Pat. No. 4,016,245; reference is made to these patents and applications for descriptions of these zeolites, their properties and methods of preparation.

The intermediate pore size materials with relatively larger size pores within the intermediate size range provided by the ten-membered rings characteristic of their crystalline structures may be used for the second dewaxing step but because they are not generally considered to offer such highly constrained access to their internal pore systems, they will not usually be so highly selective in their removal of the linear and mostly linear paraffins. They will, therefore, tend to remove some of the more desirable iso-paraffins as well, with a consequent adverse effect upon yield at well at VI. This effect will become more marked as the effective pore size of the zeolite increases so that relatively open-pored intermediate zeolites such as ZSM-12 and ZSM-38 (C.I.=2) will be far less selective than either ZSM-5 or ZSM-11 (C.I.=6–8) which will be fairly satisfactory although with some loss of yield and VI as compared to zeolites ZSM-22 and ZSM-23. However, as discussed above, the Constraint Index is not the sole determinant of dewaxing selectivity and it has been found that other intermediate pore size zeolite such as TMA offretite and ZSM-35 are effective for the selective dewaxing required in this step as they are more selective than ZSM-5. It appears that defect structures within the crystals of these zeolites may be responsible for the observed dewaxing selectivity and that although more exhaustive consideration of structural peculiarities may explain seemingly anomalous selectivity, the ultimate basis for selection of a practially useful dewaxing catalyst in this step must be the empirical determination of selectivity, as described above.

On the basis of simple structural considerations, it would also be thought that there would be a potential for selective dewaxing of the desired type with other zeolites, especially those which offer more highly constrained access to their internal pore structures than the intermediate pore size zeolites do. Because some access, although constrained, to the interior pore structure of the zeolite is require in order to effect the selective removal of the waxy paraffins, the zeolite must be capable of sorbing hydrocarbons at least to some extent. It will therefore posses pores with a minimum size of about 3.5 A° and generally these zeolites will have a minimum pore size of at least 4.0 A° although the configuration of the pore will usually preclude access by all except linear paraffins. This potential may, however, be tempered by other considerations. For example, the small pore size zeolite erionite (C.I.=38) is capable of sorbing only n-paraffins but it is ineffective in cracking long chain n-paraffins because of diffusional constraints but since the dense phase zeolite ZSM-39 will dewax effectively when combined with a suitable metal function, as described above, it is by no means inconceivable that the use of a suitable metal function with erionite would not enable selective dewaxing to be effected. The small pore synthetic zeolite, zeolite A, which sorbs only n-paraffins, is unlikely to be useful for practical reasons because it lacks sufficient stability. Other small pore zeolites such as zeolite ZSM-34, which is disclosed in U.S. Pat. No. 4,086,186, to which reference is made for a description of the zeolite, may offer similar potential although, as discussed above, the zeolite which is used in this step is best selected on the basis of empirical determination.

The dewaxing catalyst used in the second stage will normally include a metal hydrogenation-dehydrogenation component of the type described above; even though it may not be strictly necessary to promote the selective cracking reactions, its presence may be desirable to promote certain isomerization mechanisms which are involved in the cracking sequence, and for similar reasons, the dewaxing is normally carried out in the presence of hydrogen, under pressure. The use of the metal function also helps retard catalyst aging in the presence of hydrogen and, as mentioned above, may enable some zeolites such as ZSM-39 to function effectively as dewaxing catalysts. The metal will usually be of the type described above, i.e. a metal of Groups IB, IVA, VA, VIA, VIIA or VIIIA, preferably of Groups VIA or VIIIA, including base metals such as nickel, cobalt, molybdenum, tungsten and noble metals, especially platinum or palladium. The amount of the metal component will typically be 0.1 to 10 percent by weight, as described above and matrix materials and binders may be employed as necessary.

Shape selective dewaxing using these highly constrained zeolites may be carried out in the same general manner as other catalytic dewaxing processes, for example, in the same general manner and with similar conditions as those described above for the initial catalytic dewaxing step. Thus, conditions will generally be of elevated temperature and pressure with hydrogen, typically at temperatures from 250° to 500° C., more usually 300° to 450° C., pressures up to 25,000 kPa, more usually up to 10,000 kPa, space velocities of 0.1 to 10 $hr^{-1}$ (LHSV), more usually 0.2 to 5 $hr^{-1}$, with hydrogen circulation rates of 500 to 1000 $n.l.l.^{-1}$, more usually 200 to 400 $n.l.l.^{-1}$. These conditions are comparable to those described in U.S. Pat. No. 4,222,855 which describes a dewaxing process using zeolites ZSM-23 and ZSM-35 to which reference is made for a description of appropriate dewaxing conditions. Catalytic dewaxing processes are also disclosed, for example, in U.S. Pat. Nos. 4,510,045, 4,510,043, 3,844,938, 3,668,113 and Re 28,398, to which reference is made for description of relevant operating conditions.

Selective catalytic dewaxing in the second stage may be preferred to solvent dewaxing, particularly if lubricant products of especially low pour point are to be produced. MEK dewaxing is generally limited by attainable refrigerant temperatures to a product pour point of about −35° C. (about −30° F.). For products with pour points below this value, catalytic dewaxing may have to be employed, although the final product pour point which is achieved will be dependent not only upon the selectivity of the dewaxing catalyst used in the second step but also upon the severity of the operation and this, in turn, may affect the VI of the final product because if pour points below about −18° C. are to be attained, it will generally be necessary to selectively remove both n-paraffins and some of the non-normal paraffins, especially the mono-methyl paraffins, of higher melting point, in this stage. As the dewaxing becomes progressively more severe to obtain lower pour points by removing paraffins with successively greater chain braching, product VI can be expected to deteriorate correspondingly. Thus, a balance between pour point and VI will normally be struck in determining dewaxing severity unless one or the other of these properties is of paramount importance.

The conversion in the second stage will vary according to the extend of dewaxing desired at this point, i.e. on the difference between the target pour point and the pour point of the first stage effluent. It will also depend upon the selectivity of the dewaxing catalyst which is used: the minimum conversion will be that associated with the selective removal of the n-paraffins (down to pour points of about −18° C.) and of n-paraffins and the higher melting non-normal paraffins (at lower product pour points), and conversions above this will indicate non-selective hydrocracking on non-normal paraffins. At lower product pour points, therefore, and with relatively less selective dewaxing catalysts, higher conversions and correspondingly higher hydrogen consumptions will be encountered. In general terms, conversion to products boiling outside the lube range, e.g. 315° C.−, more typically 345° C.−, will be at least 5 weight percent, and in most cases at least 10 weight percent, with conversions of up to about 30 weight percent being necessary only to achieve the lowest pour points with catalysts of the required selectivity, i.e. more selective than ZSM-5. Conversion will usually run in the range 10–25 weight percent.

After the pour point of the oil has been reduced to the desired value by the selective dewaxing in the second stage, the dewaxed oil may be subjected to various finishing treatments such as hydrofinishing, clay percolation and so forth, in order to remove color bodies and produce a lube product of the desired characterists. It a catalytic dewaxing is used in the second stage, fractionation may be employed to remove light ends and to meet volatility specifications.

It it, of course, possible to use sequential dewaxing stages, particularly in the second step where the objective is simply to meet pour point rather than to improve VI concurrently, as in the first step. A particularly beneficial process sequence in this respect is to follow the first isomerization/dewaxing step with a partial solvent dewaxing and then a selective catalytic dewaxing. If this is done, the wax by-product (slack wax) from the solvent dewaxing step can be recycled to the initial isomerization/dewaxing. In this way, a lube product of low pour point, e.g. below −20° C. can be obtained by the selective catalytic dewaxing step which follows the solvent dewaxing but a high yield is obtained because the waxy components which are removed in order to obtain the final low pour point are at least partly recovered by the recycling to the initial isomerization/-dewaxing step in which they are converted at least in part to less waxy, high VI iso-paraffins. This represents and advantage over the simply two-stage catalytic dewaxing which would be required to produce very low pour point products in which the waxy components which were not removed in the initial isomerization/-dewaxing step would have to be removed entirely by the selective dewaxing in the second step by shape selective hydrocracking to products outside the distillate range and therefore lost entirely to the final lube product. The wax recycle from the solvent dewaxer therefore results in an increase in yield at constant pour point, especially for pour points below about −35° C. at which the final dewaxing step must of necessity be catalytic. Thus, the three stage dewaxing with an intermediate solvent dewaxing enables both pour point and yield to be optimized. If the wax recycling from the solvent dewaxing is employed, the preferred catalyst in the initial dewaxing step will be zeolite beta in order to maximize iso-paraffin production by isomerization of the n-paraffins from the waxy by-product.

The particular advantage of the present process in that it enables product pour point and yield to be optimized with a high degree of efficiency since it converts the waxy paraffins (which have, nevertheless, a low viscosity and high viscosity index) to the highly desirable less waxy iso-paraffins in the first dewaxing step and then enables the pour point to be reduced to the desired level in the second step. The products possess a high VI and because of this, have excellent low temperature viscosity, which makes it possible to produce lubes with good low temperature characteristics without using low molecular weight components which would tend to give rise to volatility problems. The excellent, high VI values achieved also enable the quantities of expensive VI improvers to be reduced. Furhermore, the ability of the process to produce low viscosity, high VI, low pour point lubes from such formerly unpromising refinery streams as slack wax, and to produce similar lube products in good yield from aromatic residual stocks, is a significant economic benefit to the lube refiner.

It is believed that the highly advantageous results achieved with the present process in terms of lube yield, V.I. and oher product properties can be ascribed to the differential functioning of the two dewaxing steps. It is thought that in the first step, the zeolite beta acts preferentially on the high molecular weight paraffins in the feed, i.e. the back end of the feed, converting them to iso-paraffins (with some cracking) but that it tends to leave the waxy paraffins in the front end (low molecular weight, low boiling point) of the feed unconverted until higher severity is attained. In lubricant feeds, however, the high initial boiling point implies that the paraffinic components in the front end will also be waxy and when these feeds are processed over zeolite beta, these components tend to remain in the feed so that a low pour point is not achieved except at higher severities where the yield becomes undesirabily low. The intermediate pore size zeolites such as ZSM-5 are, by contrast, more effective at removing the waxes in the front end (low boiling component) of the feed. Thus, by applying this property of the intermediate pore size zeolites in combination with the properties of zeolite beta as described above, it has become possible to evolve a two-step dewaxing process which makes the most effective use of the two types or zeolite. Zeolite beta is used in an initial stage to convert waxy paraffins to less waxy isoparaffins by isomerization, acting preferentially on the waxy components in the back end of the feed. The partly dewaxed feed is then processed over an intermediate pore size zeolite (or, alternatively, by solvent dewaxing) to deal with the waxy front end components so that the final product has a low pour point but with a viscosity index which results from the use of the zeolite beta in the first stage.

EXAMPLES 1-2

Two hydrotreated lube stocks were subjected to two stage dewaxing, using an initial, partial catalytic dewaxing over a zeolite beta-based catalyst, followed by MEK solvent dewaxing. The first lube stock (Ex. 1) was a gas oil prepared from a Minas crude by fractionation, followed by hydrotreating over a $NiMo/Al_2O_3$ hydrotreating catalyst, typically at 375°-390° C. (about 710°-735° F.), 5620 kPa (about 800 psig), 1 LHSV, 712 $n.l.l.^{-1}$ hydrogen:feed ratio. The second stock (Ex. 2) was obtained from a Statfjord crude, using similar conditions. The properties of the lube stocks are set out in Tables 3 and 4 below.

TABLE 3

| HDT Minas Feed | |
|---|---|
| Nominal boiling range, °C. (°F.) | 345-510 (650-950) |
| API Gravity | 38.2 |
| H, wt. pct. | 14.65 |
| S, wt. pct. | 0.02 |
| N, ppmw | 16 |
| Pour Point, °C. (°F.) | 38 (100) |
| KV at 100° C., cSt | 3.324 |
| P/N/A Wt. %, | |
| Paraffins | 66 |
| Naphthenes | 20 |
| Aromatics | 14 |

TABLE 4

| HDT Statfjord Feed | |
|---|---|
| Nominal boiling range, °C. | 345-455 (650-850) |
| API Gravity | 31.0 |
| H, wt. pct. | 13.76 |
| S, wt. pct. | 0.012 |
| N, ppmw | 34 |
| Pour Point, °C. (°F.) | 32 (90) |
| KV at 100° C., cSt | 4.139 |
| P/N/A wt % | |
| Paraffins | 30 |
| Naphthenes | 42 |
| Aromatics | 28 |

The two feeds were catalytically dewaxed over a Pt/zeolite beta catalyst (65 wt. percent zeolite in alumina; about 100:1 zeolite silica:alumina, 0.6 wt. percent Pt) to various intermediate product pour points by varying the severity of the dewaxing operation. The dewaxing was carried out at 2860 kPa (400 psig) hydrogen pressure, 356 n.l.l.$^{-1}$ hydrogen:feed ratio, 1 hr.$^{-1}$ LHSV and at varying temperatures from 330° to 370° C. (630°-700° F.) to achieve the desired severity.

The partially dewaxed intermediate products were then solvent dewaxed using MEK solvent with toluene as an anti-solvent at an MEK:toluene ratio of 60:40 (by weight), at a solvent:oil ratio of 3:1 (by weight). The solvent dewaxing was adjusted to give a predetermined final product pour point by chilling to about 5°-17° C. (about 10°-30° F.) below the specification pour point and then removing the precipitated wax. Pour points were determined automatically by Autopour with results equivalent to those determined by ASTM D-97.

Figure 3:
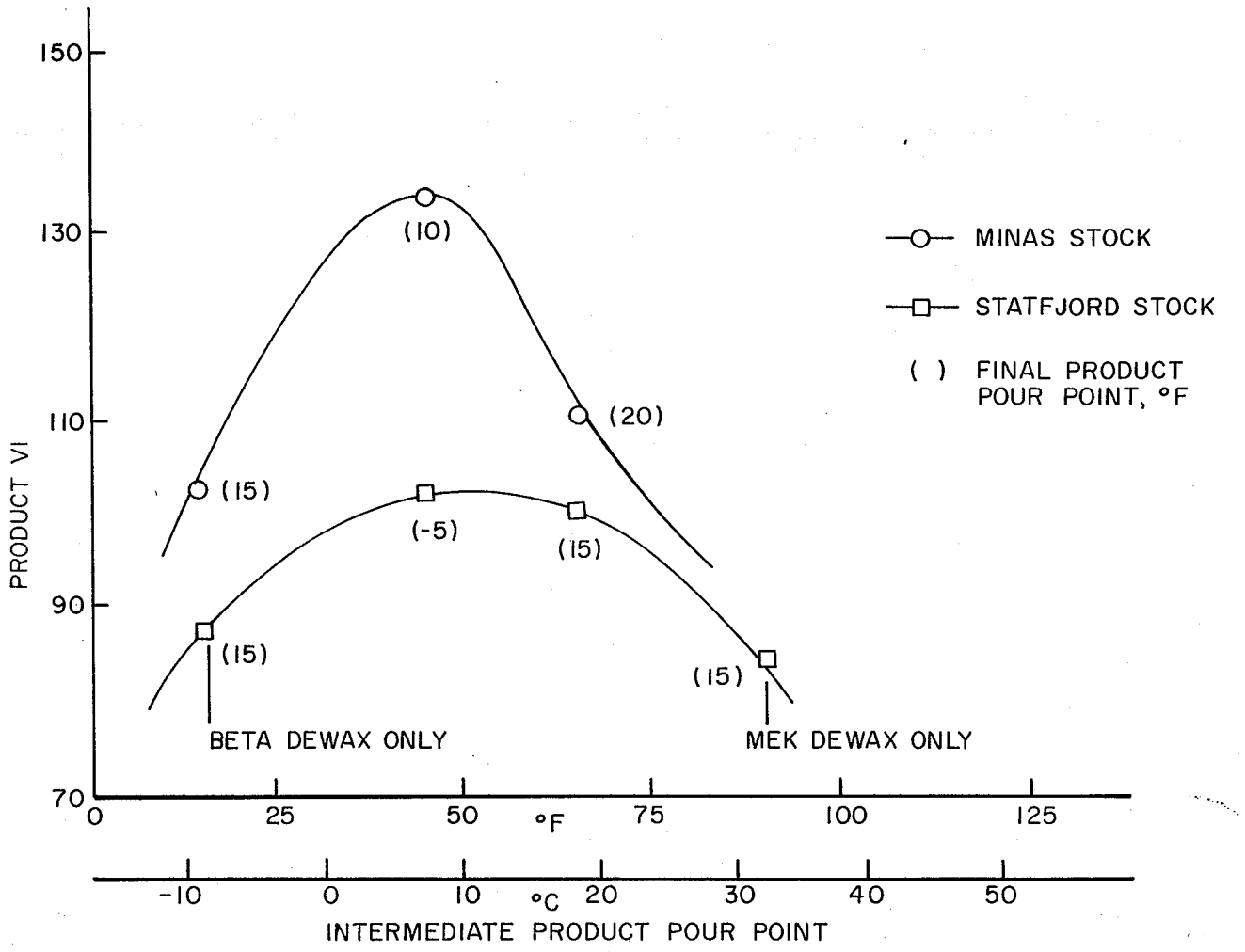

The viscosity indices of the final, dewaxed products were then determined. The results as shown in FIG. 3 which relates the VI of the product to the pour point of the partially dewaxed intermediate product. FIG. 3 shows that maximum VI values are obtained by adjusting the severity of the initial dewaxing step to an optimum value and then completing the dewaxing in a selective dewaxing step, indicating the potential for maximizing the content of the high VI iso-paraffins in the lubricant by this procedure.

EXAMPLE 3

A slack wax obtained from the solvent (MEK) dewaxing of a 300 SUS (65 cST) neutral oil obtained from Arab Light crude was sujected to successive catalytic and solvent dewaxing. The slack wax had the properties set out in Table 5 below.

TABLE 5

| Slack Wax Properties | | |
|---|---|---|
| API | 39 | |
| Hydrogen, wt. pct. | 15.14 | |
| Sulfur, wt. pct. | 0.18 | |
| Nitrogen, ppmw | 11 | |
| Melting point, °C. (°F.) | 57 (135) | |
| KV at 100° C., cSt | 5.168 | |
| PNA, wt pct: | | |
| Paraffins | 70.3 | |
| Naphthenes | 13.6 | |
| Aromatics | 16.3 | |
| Simulated Distillation: | | |
| % | °C. | (°F.) |
| 5 | 375 | (710) |
| 10 | 413 | (775) |
| 30 | 440 | (825) |
| 50 | 460 | (860) |
| 70 | 482 | (900) |
| 90 | 500 | (932) |
| 95 | 507 | (945) |

The slack wax was catalytically dewaxed over the same zeolite beta dewaxing catalyst as used in Examples 1-2, at varying severities to give different 345° C.+ (650° F.+) conversions. Temperatures were varied between about 360°-375° C. (675°-710° F.) at 2860 kPa (400 psig) hydrogen pressure, 356 n.l.l.$^{-1}$ hydrogen:feed ratio, 1 hr$^{-1}$ LHSV. Conversions varied between about 15 and 50 percent by weight.

Figure 4:
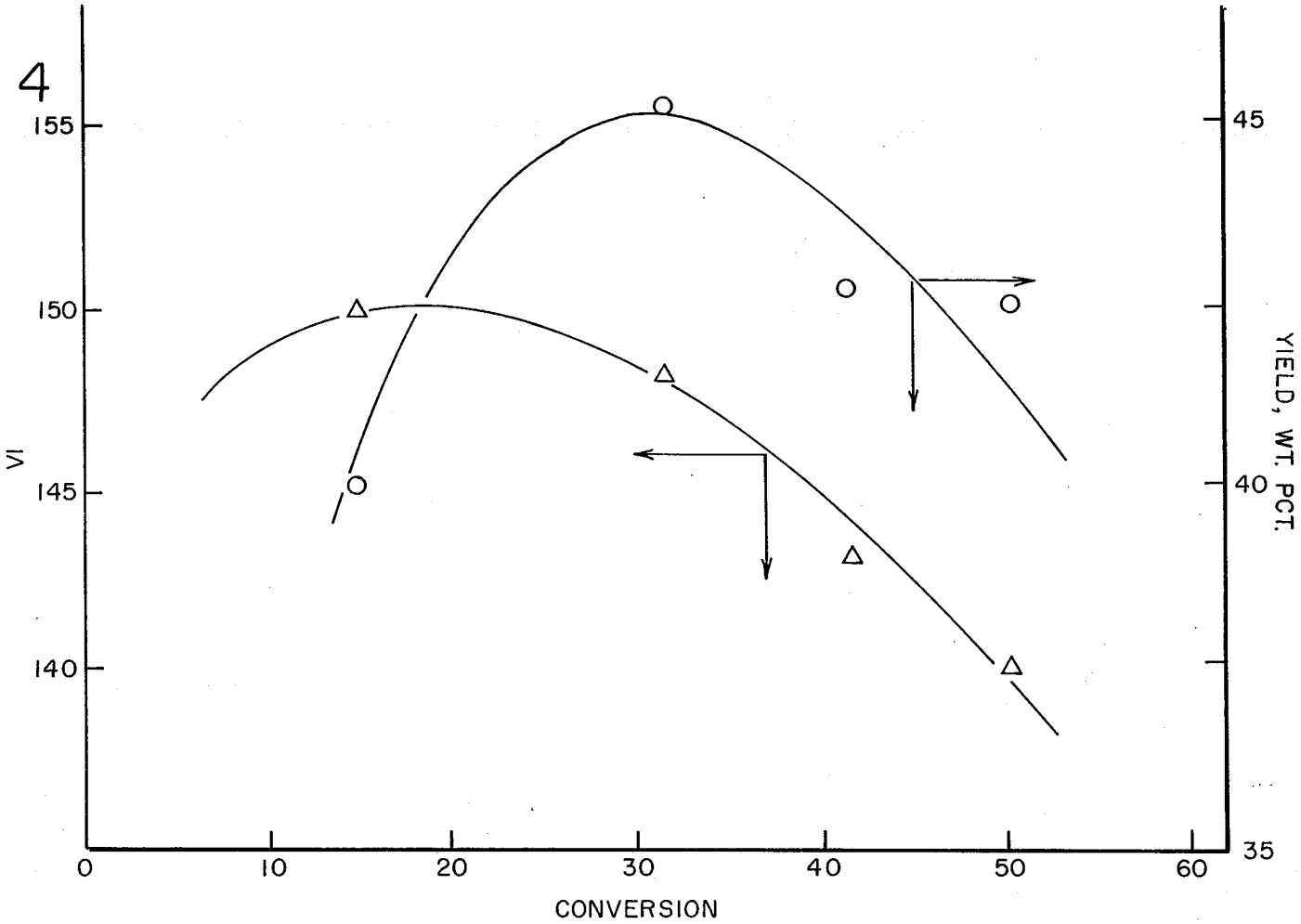

The partially dewaxed intermediate products were then subjected to solvent (MEK) dewaxing using MEK/toluene (60:40 by weight) at a solvent:oil weight ratio of 3:1, adjusting conditions to obtain a final product pour point of 20° F. (−6.7° C.). The lube yields and VI values are shown in FIG. 4. FIG. 4 indicates the potential for optimizing the process for VI efficiency or yield efficiency without signficant losses in the non-optimized variable. Furthermore, the extremely good VI values for this highly paraffinic lubricant are notable.

EXAMPLE 5

The hydrotreated Minas gas oil feed used in Example 1 was catalytically dewaxed over the zeolite beta catalyst of Examples 1-2 under the same general conditions with the temperature adjusted to give a pour point of 24° C. (75° F.) and a viscosity index of 115.1 for the partially dewaxed, intermediate product.

The intermediate product was then catalytically dewaxed for selective removal of the waxy components over a Pt/ZSM-23 dewaxing catalyst (1.0 wt. pct Pt, 114:1 $SiO_2/Al_2O_3$ ratio, 35 weight percent alumina binder) at temperatures from 315°-345° C. (600°-650° F.) to give various final product pour points, all at 2860 kPa (400 psig) hydrogen pressure, 712 n.l.l.$^{-1}$ hydrogen:feed ratio, 1 hr$^{-1}$ LHSV. The viscosity indices of the products are given in Table 6 below.

TABLE 6

| Two Stage Beta/ZSM-23 Dewaxing | |
|---|---|
| Pour Point, °C. (°F.) | VI |
| −20 (−5) | 107.5 |
| −29 (−20) | 105.4 |
| −40 (−40) | 103.5 |

These result may be compared to those obtained by dewaxing the same hydrotreated feed over the ZSM-23 dewaxing catalyst alone, as shown in Table 7 below.

TABLE 7

| Single Stage ZSM-23 Dewaxing | |
|---|---|
| Pour Point, °C. (°F.) | VI |
| −9 (+15) | 101.4 |

Comparison shows that the present two stage dewaxing achieves higher VI values in the final product even at lower pour points.

EXAMPLE 6

In this example, which shows the effect of two step processing on catalyst aging, lube yield and product V.I., the charge stock was a severely hydrotreated waxy heavy neutral base stock having the following properties:

TABLE 8

| HN Basestock Properties | |
|---|---|
| Specific Gravity, API° | 32.8 |
| Pour Point, °F. (°C.) | +130° (+54) |
| Viscosity, KV at 100° C., cSt | 10.39 |
| Nitrogen, ppmw | 19 |
| CCR | *0.1 |

*Less than

A fixed bed, down-flow operation was employed for a cascade, two-step dewaxing scheme and for a single-stage processing. In the cascade operation, 10 cc of 0.6% Pt/Zeolite Beta/$Al_2O_3$ extrudate catalyst (steamed at 1000° F. (538° C.) for 72 hours prior to platinum exchange) was mixed with an equal volume of sand and placed in the first reactor. A steamed 1.1%

Ni/ZSM-5/$Al_2O_3$ extrudate catalyst (10 cc) was mixed with an equal volume of sand and placed in the second reactor. Both catalysts were presulfided prior to catalytic lube processing. For single-stage processing, the first catalyst was by-passed and the feedstock was directly charge into the second reactor. Processing was carried out in the presence of hydrogen with temperatures adjusted to give a final product pour point of +20° F. (−70° C.). The results and process conditions are given in Table 9 below.

TABLE 9

| Cascade/Single Stage Comparison - HN Feed | Cascade | Single-Stage |
|---|---|---|
| Pressure, psig (KPa abs.) | 400 (2860) | 400 (2860) |
| $H_2$ Circulation, SCF/B (n.l.l.$^{-1}$) | 4000 (712) | 4000 (712) |
| Temp., °F. (°C.) | | |
| 1st Reactor (Pt/Zeolite Beta) | 575 (302) | — |
| 2nd Reactor (Ni/ZSM-5) | 530 (277) | 605 (472) |
| LHSV | | |
| 1st Reactor | 1.1 | — |
| 2nd Reactor | 1.1 | 1.1 |
| Product Yield, wt. pct. | | |
| $C_1 + C_2$ | 0.1 | 0.5 |
| $C_3 + C_4$ | 5.6 | 15.6 |
| $C_5$ - 330° F. Naphtha | 15.7 | 19.3 |
| 330°-540° F. Distillate | 10.8 | 2.6 |
| 650° F.+ Lube | 67.8 | 62.0 |
| Properties of Lube | | |
| Pour Point (1st Reactor), °F. (°C.) | +75 (24) | — |
| Pour Point (2nd Reactor), °F. (°C.) | +20 (−7) | +20 (−7) |
| VI (2nd Reactor) | 97 | 88 |
| Catalyst Aging Rate, °F./Day (°C./Day$^{-1}$) | | |
| 1st Reactor | | — |
| 2nd Reactor | | 2.7 (1.5) |

EXAMPLE 7

For this example, a severely hydrotreated waxy bright stock was used having the following properties:

TABLE 10

| Bright stock Properties | |
|---|---|
| Specific Gravity, API° | 28.8 |
| Pour Point, °F. (°C.) | 160 + (+71) |
| Viscosity KV at 100° C., cSt | 26.9 |
| Nitrogen, ppmw | 2 |
| CCR | 0.4 |

The same experimental procedures as in Example 1 were employed except that reactor temperatures were adjusted to produce a product with a pour point of +10° F. (−12° C.). The results and the processing conditions are shown in detail in Table 11.

TABLE 11

| Cascade/Single Stage Comparison - BS Feed | Cascade | Single-Stage |
|---|---|---|
| Pressure, psig (KPa abs.) | 400 (2860) | 400 (2860) |
| $H_2$ Circulation, SCF/B (n.l.l.$^{-1}$) | 4000 (712) | 4000 (712) |
| Temp., °F. (°C.) | | |
| 1st Reactor (Pt/Zeolite Beta) | 575 (302) | — |
| 2nd Reactor (Ni/ZSM-5) | 530 (277) | 605 (472) |
| LHSV | | |
| 1st Reactor | 1.1 | — |
| 2nd Reactor | 1.1 | 1.1 |
| Product Yield, wt. pct. | | |
| $C_4$− | 9.5 | 19.0 |
| $C_5$−330° F. Naphtha | 17.6 | 18.0 |
| 330-650° F. Distillate | 8.6 | 4.0 |
| 650° F.+Lube | 64.3 | 59.0 |
| Properties of Lube | | |

TABLE 11-continued

| Cascade/Single Stage Comparison - BS Feed | Cascade | Single-Stage |
|---|---|---|
| Pour Point (1st Reactor) | +75 | — |
| Pour Point (2nd Reactor), °F. (°C.) | +10 | +10 |
| Catalyst Aging Rate, °F./Day (°C./Day$^{-1}$) | | |
| 1st Reactor | 0.3 (0.17) | — |
| 2nd Reactor | 0.5 (0.28) | 9.7 (5.4) |

EXAMPLE 8

This example demonstrates the effect of differences of pressure on the lube yield obtained from the first stage (hydroisomerization) reactor using hydrotreated waxy bright stock as a charge stock, with target pour points of 75° F. (24° C.) and 30° F. (−1° C.). The same catalyst and experimental procedures as in Example 6 (first reactor) were employed. The results and the processing conditions are given in Table 12 below.

TABLE 12

| Effect of Pressure on Lube Yield From Hydroisomerization | | | | |
|---|---|---|---|---|
| Pressure, psig (kPa abs) | 400 (2860) | 2800 (19410) | 400 (2860) | 2800 (19410) |
| Pour Point of Lube, °F. (°C.) | +75 (24) | +75 (24) | +30 (−1) | +30 (−1) |
| Temp., °F. (°C.) | 575 (302) | 573 (300) | 602 (316) | 616 (324) |
| Product Yield, wt % | | | | |
| $C_4$ | 0.9 | 0.0 | 5.1 | 0.9 |
| $C_5$−330° F. Naphtha | 3.4 | 3.9 | 23.7 | 32.1 |
| 330-650° F. Distillate | 7.2 | 9.9 | 20.9 | 21.9 |
| 650° F.+ Lube | 88.5 | 86.2 | 50.3 | 44.9 |

Table 12 shows that at a given target pour point lower pressure gave a higher lube yield. Table 12 also shows that the lube yield from the first stage reactor decreased from 88.5 wt pct to 50.3 wt pct when the pour point of the lube fraction was reduced from +75° (24° C.) to +30° F. (−1° C.). This indicates that severe conditions in the first stage reactor would significantly reduce the overall yield in the cascade two-stage operation since the 50.3 wt pct lube yield is already below the 59 wt pct lube yield which can achieved from single-stage shape selective dewaxing alone, as illustrated in Table 11. Therefore, it is not desirable to operate the first stage in such a way that the pour point of the lube fraction is reduced to below approximately +50° F., and preferably +70° F. with this feed.

We claim:

1. A process for producing a lubricating oil of improved pour point and viscosity index which comprises (i) catalytically dewaxing a lube feed stock having an initial boiling point of at least 650° F. containing waxy, paraffinic components in an initial catalytic dewaxing step with a dewaxing catalyst comprising zeolite beta having a silica:alumina ratio of at least 10:1 and a hydrogenation-dehydrogenation component, in the presence of hydrogen under dewaxing conditions of elevated temperature from 480° to 850° F. and pressure of up to 1000 psig and at a contact time between the feed and the catalyst which effects a partial removal of the waxy components by isomerization of the waxy paraffinic components to less waxy iso-paraffinic components, to increase the content of iso-paraffinic components in the stock relative to the content of iso-paraffinic components in the feed; and (ii) subjected the effluent from the initial catalytic dewaxing step to a selective dewaxing operation in which straight chain, waxy paraffinic components are removed in preference to iso-paraffinic components, to lower the pour point of the stock to produce a dewaxed lubricant product having a targeted pour point and viscosity index.

2. A process according to claim 1 in which the pour point of the feed stock is reduced during the initial catalytic dewaxing step to a value which is no lower than 10° F. above the target pour point of the product.

3. A process according to claim 2 in which the pour point of the effluent from the initial catalytic dewaxing step is reduced to a value no lower than 20° F. above the pour point of the product.

4. A process according to claim 2 in which the pour point of the feed stock is reduced by at least 10° F. during the initial catalytic dewaxing step.

5. A process according to claim 4 in which the pour point of the feed stock is reduced by at least 20° F. during the initial catalytic dewaxing step.

6. A process according to claim 1 in which the dewaxing catalyst of the initial catalytic dewaxing step comprises zeolite beta having a silica:alumina ratio of at least 30:1 and a hydrogenation-dehydrogenation component comprising at least one metal of Groups IVA, VA, VIA, VIIA or VIIIA of the Periodic Table of the Elements.

7. A process according to claim 6 in which the dewaxing catalyst of the initial catalytic dewaxing step comprises zeolite beta having a silica:alimina ratio of at least 30:1 and a hydrogenation-dehydrogenation component comprising at least one of the metals nickel, cobalt, molybdenum, tungsten or vanadium.

8. A process according to claim 6 in which the dewaxing catalyst of the initial catalytic dewaxing step comprises zeolite beta having a silica:alumina ratio of at least 30:1 and a hydrogenation-dehydrogenation component comprising at least one of the metals platinum or palladium.

9. A process according to claim 1 in which the selective dewaxing operation comprises solvent dewaxing.

10. A process according to claim 1 in which the selective dewaxing operation comprises a shape-selective catalytic dewaxing operation in which the effluent of the initial catalytic dewaxing step is dewaxed using a shape-selective catalyst which has a dewaxing selectivity at least as that of ZSM-5.

11. A process according to claim 10 in which the dewaxing catalyst in the selective dewaxing operation comprises an intermediate pore zeolite having a Constraint Index of at least 8, an n-hexane sorption of less than 10 weight percent at 50° C. and a cyclohexane sorption of less than 5 weight percent at 50° C.

12. A process according to claim 11 in which the dewaxing catalyst in the selective dewaxing operation has an n-hexane sorption of less than 5 weight at 50° C.

13. A process according to claim 10 in which the dewaxing catalyst in the selective dewaxing operation comprises ZSM-22 or ZSM-23.

14. A process according to claim 10 in which the dewaxing catalyst in the selective dewaxing operation comprises ZSM-35.

15. A dewaxing process for producing a hydrocarbon lubricant of improved pour point and viscosity index from a lube feed stock having an initial boiling point of at least 650° F., an initial high pour point and including waxy components comprising straight an slightly branched chain paraffins together with branched chain isoparaffins, which method comprises (i) partially dewaxing the base stock in an initial low pressure catalytic hydroisomerization dewaxing step which comprises contacting the base stock under dewaxing conditions of elevated temperature from 480° to 850° F. and pressure of not more than 1000 psig in the presence of hydrogen with a dewaxing catalyst comprising zeolite beta having a silica:alumina ratio of at least 30:1 and hydrogenation-dehydrogenation component, at a contact time between the feed and the catalyst which effects a partial removal of the waxy components by isomerization of the waxy paraffinic components to less waxy iso-paraffinic components, to increase the iso-paraffin content of the stock relative to the iso-paraffinic content of the feed and effect a reduction in the pour point of the base stock, producing a partially dewaxed effluent; and (ii) subjecting the partially dewaxing effluent to a selective dewaxing operation to effect a further removal of the waxy components while minimizing removal of the branched chain isoparaffinic components, to produce a dewaxed lubricant product having a targeted pour point and viscosity index.

16. A process according to claim 15 in which the severity of the initial catalytic dewaxing operation is selected to reduce the pour point of the feed stock to a value not lower than 10° F. above the target pour point for the product.

17. A process according to claim 15 in which the severity of the initial dewaxing operation is selected to reduce the pour point of the feed stock to a value not lower than 20° F. above the target pour point for the product.

18. A process according to claim 15 in which the pour point of the feed stock is reduced by at least 10° F. during the initial catalytic dewaxing operation.

19. A process according to claim 18 in which the pour point of the feed stock is reduced by at least 20° F. during the initial catalyst dewaxing operation.

20. A process according to claim 15 in which the dewaxing catalyst in the initial catalytic dewaxing operation comprises zeolite beta having a silica:alumina ratio of at least 30:1 and a hydrogenation-dehydrogenation component comprising at least one metal of group IVA, VA, VIA, VIIA or VIIIA of the Periodic Table of the Elements.

21. A process according to claim 15 in which the selective dewaxing operation comprises a solvent dewaxing operation.

22. A process according to claim 15 in which the selective dewaxing operation comprises a catalytic dewaxing operation in which the effluent of the initial catalytic dewaxing step is dewaxed using a shape selective dewaxing catalyst comprising an intermediate pore zeolite having a dewaxing selectivity greater than that of ZSM-5.

23. A process according to claim 22 in which the selective dewaxing operation is carried out over a dewaxing catalyst comprising ZSM-22 or ZSM-23.

24. A process according to claim 22 in which the selective dewaxing operation is carried out over a dewaxing catalyst comprising ZSM-35.

25. A process according to claim 15 in which the feed stock comprises a highly paraffinic base stock having a paraffin content of at least 60 weight percent and a pour point (ASTM D-97) of at least 40° C.

26. A process for the production of a liquid lubricant product of low viscosity, high viscosity index an low pour point from a highly paraffinic hydrocarbon feed having a paraffin content of at least 60 weight percent, which comprises:

(i) partially dewaxing the base stock in an initial catalytic dewaxing step which comprises contacting the base stock under dewaxing conditions of elevated temperature from 480° to 850° F. and pressure of not more than 1000 psig in the presence of hydrogen with a dewaxing catalyst comprising a zeolite beta and a hydrogenation-dehydrogenation component and at a contact time between the feed and the catalyst which effects a partial removal of the waxy components by isomerization to iso-paraffins so as to increase the content of iso-paraffins relative to the feed while decreasing the content of n-paraffins relative to the feed thereby effecting a reduction in the pour point of the base stock, producing a partially dewaxed effluent having an incresed content of iso-paraffins, and (ii) subjecting the partially dewaxed effluent to a selective dewaxing operation having a dewaxing selectivity at least as great as that of a catalytic dewaxing operation using a ZSM-5 dewaxing catalyst to effect a further removal of the waxy components while minimizing removal of the branched chain isoparaffinic components, to produce a dewaxed lubricant product having improved pour point and viscosity index.

27. A process according to claim 26 in which the selective dewaxing operation includes a solvent dewaxing step which produces a dewaxed product and a waxy by-product.

28. A process according to claim 27 in which the dewaxed product from the solvent dewaxing step is subjected to further dewaxing in a catalytic dewaxing operation using a dewaxing catalyst having a dewaxing selectivity greater than that of ZSM-5, to produce a product of pour and viscosity index.

29. A process according to claim 27 in which the waxy by-product is recycled to the initial catalytic dewaxing step.

30. A process according to claim 28 in which the waxy by product is recycled to the initial catalytic dewaxing step.

* * * * *